US009802213B2

(12) United States Patent
Joseph et al.

(10) Patent No.: US 9,802,213 B2
(45) Date of Patent: Oct. 31, 2017

(54) SPRAY GUN HAVING INTERNAL BOOST PASSAGEWAY

(71) Applicant: 3M INNOVATIVE PROPERTIES COMPANY, St. Paul, MN (US)

(72) Inventors: Stephen C. P. Joseph, Woodbury, MN (US); Scott D. Gullicks, Woodbury, MN (US); Russell E. Blette, Hastings, MN (US); Jameel R. Qiblawi, Mendota Heights, MN (US)

(73) Assignee: 3M INNOVATIVE PROPERTIES COMPANY, Saint Paul, MN (US)

( * ) Notice: Subject to any disclaimer, the term of this patent is extended or adjusted under 35 U.S.C. 154(b) by 0 days.

(21) Appl. No.: 14/382,988

(22) PCT Filed: Mar. 5, 2013

(86) PCT No.: PCT/US2013/028985

§ 371 (c)(1),
(2) Date: Sep. 4, 2014

(87) PCT Pub. No.: WO2013/134182

PCT Pub. Date: Sep. 12, 2013

(65) Prior Publication Data

US 2015/0028131 A1 Jan. 29, 2015

Related U.S. Application Data

(60) Provisional application No. 61/607,386, filed on Mar. 6, 2012, provisional application No. 61/643,745, filed on May 7, 2012.

(51) Int. Cl.

| | |
|---|---|
| ***B05B 7/24*** | (2006.01) |
| ***B05B 7/06*** | (2006.01) |
| ***B05B 7/08*** | (2006.01) |

(52) U.S. Cl.
CPC ..... *B05B 7/2432* (2013.01); *B05B 7/066* (2013.01); *B05B 7/0815* (2013.01); *B05B 7/241* (2013.01);
(Continued)

(58) Field of Classification Search
CPC ..... B05B 7/2402; B05B 7/2408; B05B 7/241; B05B 7/2432; B05B 7/2478; B05B 7/2494
See application file for complete search history.

(56) References Cited

U.S. PATENT DOCUMENTS

| | | | |
|---|---|---|---|
| 1,299,290 | A | 4/1919 | Berg |
| 1,539,536 | A | 5/1925 | Bartling |

(Continued)

FOREIGN PATENT DOCUMENTS

| | | |
|---|---|---|
| CN | 1280885 | 1/2001 |
| CN | 2431971 | 5/2001 |

(Continued)

OTHER PUBLICATIONS

Ihmels, Manfred, Ihmels Article—Sata, Feb. 15, 1989, 2 pages.
International Search Report for PCT International Application No. PCT/US2013/028985, dated Jun. 21, 2013, 5 pgs.

*Primary Examiner* — Ryan Reis
(74) *Attorney, Agent, or Firm* — Aleksander Medved

(57) ABSTRACT

A barrel (20) adapted for use with a spray gun (2) is disclosed. The barrel (20) comprises a boost feed port (44) fluidly connected to a boost passageway (48), the boost passageway (48) being integral to the barrel (20). The boost passageway (48) is adapted to convey a pressurized boost fluid originating in the spray gun (2) to a boost delivery port (56) to assist in urging a coating fluid from a compatible coating fluid reservoir (80) for spraying by the spray gun (2).

33 Claims, 20 Drawing Sheets

(52) U.S. Cl.
CPC ..... *B05B 7/2402* (2013.01); *B05B 7/2408* (2013.01); *B05B 7/2437* (2013.01); *B05B 7/2443* (2013.01); *B05B 7/2478* (2013.01); *B05B 7/2481* (2013.01)

(56) References Cited

U.S. PATENT DOCUMENTS 1,748,440 A 2/1930 Burdick
2,042,746 A 6/1936 Tracy
2,059,706 A 11/1936 Paasche
2,126,888 A 8/1938 Jenkins
2,303,280 A 11/1942 Jenkins
2,362,946 A 11/1944 Stockdale
2,497,625 A 2/1950 Norwick
2,820,670 A 1/1958 Charlop
2,886,252 A 5/1959 Ehrensperger
2,904,262 A * 9/1959 Peeps ..... B05B 7/0815 239/290
2,991,940 A 7/1961 Dupler
3,062,453 A 11/1962 Matthews
3,157,360 A * 11/1964 Heard ..... B05B 7/2435 222/214
3,168,250 A 2/1965 Paasche
3,236,459 A 2/1966 McRitchie
3,270,920 A * 9/1966 Nessler ..... B05B 7/2472 222/136
3,515,354 A 6/1970 Presson
3,581,998 A 6/1971 Roche
3,623,669 A 11/1971 Woods
3,633,828 A 1/1972 Larson
3,876,150 A 4/1975 Dwyer
3,942,680 A 3/1976 Seeley
4,160,525 A 7/1979 Wagner
4,392,617 A 7/1983 Bakos
4,403,738 A 9/1983 Kern
4,513,913 A 4/1985 Smith
4,529,126 A 7/1985 Ives
4,537,357 A 8/1985 Culbertson
4,562,965 A 1/1986 Ihmels
4,615,485 A 10/1986 Larson
4,657,184 A 4/1987 Weinstein
4,660,774 A 4/1987 Kwok
4,712,739 A 12/1987 Bihn
4,811,904 A 3/1989 Ihmels
4,815,666 A 3/1989 Gacka
4,817,872 A 4/1989 Mattson
4,830,281 A 5/1989 Calder
4,925,101 A 5/1990 Konieczynski
4,971,251 A 11/1990 Dobrick
4,993,642 A 2/1991 Hufgard
5,022,590 A 6/1991 Buschor
5,110,011 A 5/1992 Laska
5,119,992 A 6/1992 Grime
5,152,460 A 10/1992 Barty
5,178,330 A 1/1993 Rodgers
5,242,115 A 9/1993 Brown
5,279,461 A 1/1994 Darroch
5,280,853 A 1/1994 Perret
5,322,221 A 6/1994 Anderson
5,332,156 A 7/1994 Wheeler
5,395,046 A 3/1995 Knobbe
5,454,517 A 10/1995 Naemura
5,456,414 A 10/1995 Burns
5,474,450 A 12/1995 Chronister
5,582,350 A 12/1996 Kosmyna
5,607,108 A 3/1997 Garlick
5,609,302 A 3/1997 Smith
5,613,637 A 3/1997 Schmon
5,711,421 A 1/1998 Guo
5,765,753 A 6/1998 Kieffer
5,875,971 A 3/1999 Morck
5,961,050 A 10/1999 Kitajima
5,979,797 A 11/1999 Castellano
6,012,651 A 1/2000 Spitznagel
6,019,294 A 2/2000 Anderson
6,056,213 A 5/2000 Ruta
6,068,203 A 5/2000 DeYoung
6,085,996 A 7/2000 Culbertson
D429,794 S 8/2000 Beaver
6,098,902 A 8/2000 Culbertson
6,105,881 A 8/2000 Kitajima
6,254,015 B1 7/2001 Abplanalp
6,345,776 B1 2/2002 Hurray
6,375,096 B1 4/2002 Rashidi
6,425,536 B2 7/2002 Namura
6,450,422 B1 9/2002 Maggio
6,460,787 B1 10/2002 Hartle
6,494,387 B1 12/2002 Kaneko
6,502,763 B1 1/2003 McCann
6,536,687 B1 3/2003 Navis
6,543,705 B1 4/2003 Liao
6,601,782 B1 8/2003 Sandholm
6,685,106 B1 2/2004 Van der Steur
6,702,198 B2 3/2004 Tam
6,719,212 B1 4/2004 Leisi
6,749,132 B2 6/2004 Pettit
6,793,155 B2 9/2004 Huang
6,805,306 B1 10/2004 Huang
6,808,122 B2 10/2004 Mitcheli
6,820,824 B1 11/2004 Joseph
6,854,667 B2 2/2005 Ulrich
6,860,438 B1 3/2005 Huang
6,874,702 B2 4/2005 Turnbull
6,935,577 B2 8/2005 Strong
6,953,155 B2 10/2005 Joseph
6,971,590 B2 12/2005 Blette
7,032,839 B2 4/2006 Blette
7,083,119 B2 8/2006 Bouic
7,097,118 B1 8/2006 Huang
7,165,732 B2 1/2007 Kosmyna
D538,886 S 3/2007 Huang
7,201,336 B2 4/2007 Blette
D542,375 S 5/2007 Blette
D542,376 S 5/2007 Blette
7,237,727 B2 7/2007 Wang
7,246,759 B2 7/2007 Turnbull
D548,816 S 8/2007 Schmon
7,328,855 B2 2/2008 Chatron
RE40,433 E 7/2008 Schmon
D572,343 S 7/2008 Huang
7,484,676 B2 2/2009 Joseph
7,513,443 B2 * 4/2009 Escoto, Jr. ..... B05B 7/2481 215/11.1
7,694,896 B2 4/2010 Turnbull
D616,527 S 5/2010 Anderson
7,712,682 B2 5/2010 Joseph
7,757,972 B2 7/2010 Kosmyna
7,789,324 B2 9/2010 Bouic
7,789,327 B2 9/2010 Micheli
7,798,061 B2 9/2010 Dilou
7,891,588 B2 2/2011 Jones
7,922,107 B2 4/2011 Fox
7,971,806 B2 7/2011 Johnson
8,066,205 B2 * 11/2011 Bass ..... B05B 7/066 239/337
8,297,536 B2 10/2012 Ruda
8,313,047 B2 11/2012 Micheli
8,360,345 B2 1/2013 Micheli
8,500,043 B2 8/2013 Heigl
8,590,809 B2 11/2013 Escoto, Jr.
8,684,281 B2 4/2014 Micheli
2002/0104898 A1 8/2002 Bonnique
2003/0071144 A1 4/2003 Naemura
2003/0111553 A1 6/2003 Hunter
2003/0173419 A1 9/2003 Huang
2004/0089742 A1 * 5/2004 Antonucci ..... B05B 7/2416 239/302
2004/0140373 A1 7/2004 Joseph
2004/0195401 A1 10/2004 Strong
2004/0245673 A1 12/2004 Allsop
2004/0256484 A1 12/2004 Joseph
2004/0256493 A1 12/2004 Turnbull
2005/0016448 A1 1/2005 Dilou
2005/0035220 A1 2/2005 Brown

(56) References Cited

U.S. PATENT DOCUMENTS

| | | | | |
|---|---|---|---|---|
| 2005/0045741 | A1 | 3/2005 | Brown | |
| 2005/0087128 | A1 | 4/2005 | Jakupovic | |
| 2005/0145724 | A1 | 7/2005 | Blette | |
| 2005/0173561 | A1 | 8/2005 | Cotter | |
| 2006/0000927 | A1 | 1/2006 | Ruda | |
| 2006/0065761 | A1 | 3/2006 | Joseph | |
| 2006/0097070 | A1 | 5/2006 | Huffman | |
| 2006/0102550 | A1 | 5/2006 | Joseph | |
| 2006/0175433 | A1* | 8/2006 | Escoto, Jr. | B05B 7/2481 239/302 |
| 2006/0186223 | A1 | 8/2006 | Wang | |
| 2007/0102535 | A1 | 5/2007 | Carey | |
| 2007/0262169 | A1 | 11/2007 | Wang | |
| 2007/0262172 | A1 | 11/2007 | Huffman | |
| 2008/0078849 | A1 | 4/2008 | Fox | |
| 2008/0093479 | A1 | 4/2008 | Delbridge | |
| 2008/0272213 | A1 | 11/2008 | Ting | |
| 2009/0026290 | A1 | 1/2009 | Fox | |
| 2009/0121048 | A1 | 5/2009 | Noshima | |
| 2009/0302133 | A1 | 12/2009 | Micheli | |
| 2010/0108783 | A1 | 5/2010 | Joseph | |
| 2010/0123024 | A1 | 5/2010 | Gohring | |
| 2010/0133358 | A1* | 6/2010 | Gohring | B05B 7/0081 239/337 |
| 2010/0187333 | A1 | 7/2010 | Escoto, Jr. | |
| 2010/0282868 | A1 | 11/2010 | Heigl | |
| 2011/0168811 | A1 | 7/2011 | Fox | |
| 2013/0092760 | A1 | 4/2013 | Joseph | |
| 2013/0327850 | A1 | 12/2013 | Joseph | |
| 2014/0014741 | A1 | 1/2014 | Escoto | |
| 2014/0246519 | A1 | 9/2014 | Johnson | |
| 2015/0028131 | A1 | 1/2015 | Joseph | |

FOREIGN PATENT DOCUMENTS

| | | |
|---|---|---|
| CN | 1827231 | 9/2006 |
| DE | 3815327 | 11/1989 |
| DE | 4027421 | 3/1992 |
| DE | 4302911 | 8/1993 |
| DE | 19503495 | 8/1996 |
| DE | 19605227 | 8/1997 |
| DE | 10315426 | 6/2004 |
| DE | 60005536 | 7/2004 |
| DE | 102004027789 | 2/2005 |
| DE | 102004044475 | 12/2005 |
| DE | 102007012989 | 10/2007 |
| DE | 202011050102 | 9/2011 |
| EP | 279992 | 8/1988 |
| EP | 509367 | 10/1992 |
| EP | 0492333 | 3/1995 |
| EP | 0885658 | 12/1998 |
| EP | 1340550 | 9/2003 |
| EP | 1479447 | 11/2004 |
| EP | 1554051 | 4/2006 |
| EP | 1682231 | 7/2006 |
| EP | 1699565 | 6/2008 |
| EP | 1964616 | 9/2008 |
| EP | 2108460 | 10/2009 |
| EP | 2386360 | 11/2011 |
| EP | 2486985 | 8/2012 |
| GB | 425382 | 9/1934 |
| GB | 829370 | 3/1960 |
| GB | 1231041 | 5/1971 |
| GB | 1293341 | 10/1972 |
| GB | 1338099 | 11/1973 |
| JP | 63-39448 | 3/1988 |
| JP | H07-265751 | 10/1995 |
| JP | H08215628 | 8/1996 |
| JP | H1028906 | 2/1998 |
| JP | 11114458 | 4/1999 |
| JP | 20021169 | 1/2002 |
| JP | 2003112086 | 4/2003 |
| JP | 2005211699 | 8/2005 |
| JP | 2007175650 | 7/2007 |
| KR | 10-0435685 | 6/2004 |
| KR | 20-0428831 | 10/2006 |
| NL | 1024774 | 3/2004 |
| RU | 2014906 | 6/1994 |
| RU | 2060383 | 5/1996 |
| SU | 172206 | 1/1965 |
| SU | 1111832 | 9/1984 |
| SU | 1423175 | 9/1988 |
| SU | 1613181 | 12/1990 |
| WO | WO 03/051524 | 6/2003 |
| WO | WO 2004/037432 | 5/2004 |
| WO | WO 2004/037433 | 5/2004 |
| WO | WO 2004/087332 | 10/2004 |
| WO | WO 2005/049145 | 6/2005 |
| WO | WO 2005/063361 | 7/2005 |
| WO | WO 2006/053229 | 5/2006 |
| WO | WO 2006/098623 | 9/2006 |
| WO | WO 2006/107935 | 10/2006 |
| WO | WO 2007/056589 | 5/2007 |
| WO | WO 2007/104967 | 9/2007 |
| WO | WO 2007/139639 | 12/2007 |
| WO | WO 2008/016557 | 2/2008 |
| WO | WO 2012/109298 | 8/2012 |
| WO | WO 2013/016474 | 1/2013 |
| WO | WO 2013/055730 | 4/2013 |
| WO | WO 2015/009475 | 1/2015 |

* cited by examiner

SPRAY GUN HAVING INTERNAL BOOST PASSAGEWAY

CROSS REFERENCE TO RELATED APPLICATIONS

This application is a national stage filing under 35 U.S.C. 371 of PCT/US2013/028985, filed Mar. 5, 2013, which claims priority to U.S. Provisional Application No. 61/607,386, filed Mar. 6, 2012, and to Provisional Application No. 61/643,745, filed May 7, 2012, the disclosures of which are incorporated by reference in their entireties herein.

BACKGROUND

Spray guns are known for use in the application of liquids such as paints across many industries. Such spray guns commonly include a gun body, a reservoir for holding a liquid to be sprayed, and an air source to assist in atomizing and propelling the liquid onto a surface to be coated. Often, coating liquids are expensive, and it is therefore desirable to use as much of the liquid as possible to minimize waste. Moreover, relatively viscous coating liquids can be difficult to remove from the reservoir under the influence of gravity or a siphon.

There is a need for improved systems and methods for removing coating liquids from a reservoir for application by a spray gun.

SUMMARY OF THE INVENTION

Exemplary embodiments according to the present disclosure include, but are not limited to, the embodiments listed below, which may or may not be numbered for convenience. Several additional embodiments, not specifically enumerated in this section, are disclosed within the accompanying detailed description.

Embodiment 1

A barrel adapted for use with a spray gun, the barrel comprising:

a boost feed port fluidly connected to a boost passageway, the boost passageway being integral to the barrel;

wherein the boost passageway is adapted to convey a pressurized boost fluid originating in the spray gun to a boost delivery port to assist in urging a coating fluid from a compatible coating fluid reservoir for spraying by the spray gun.

Embodiment 2

The barrel of Embodiment 1 further comprising:

a fluid interface adapted to connect the barrel to a coating fluid reservoir, the fluid interface comprising a fluid port;

a fluid nozzle opening through which a coating fluid to be sprayed can exit the barrel, the fluid nozzle opening being fluidly connected to the fluid port by a fluid passageway formed within the barrel;

wherein the fluid passageway is adapted to convey a coating fluid urged from the compatible coating fluid reservoir out of the fluid nozzle opening for spraying by the spray gun.

Embodiment 3

The barrel of any of Embodiments 1-2 further comprising a gun interface adapted to connect the barrel to a spray gun platform.

Embodiment 4

The barrel of any of Embodiments 2-3 wherein the fluid interface comprises the boost delivery port.

Embodiment 5

The barrel of any of Embodiments 2-4 wherein the boost delivery port is created by connection of the fluid interface to a compatible coating fluid reservoir.

Embodiment 6

The barrel of any of Embodiments 1 to 5 wherein at least a portion of the boost passageway is created by connection of the barrel to a compatible coating fluid reservoir.

Embodiment 7

The barrel of any of Embodiments 3 to 6 wherein the gun interface comprises an coating fluid chamber and the boost feed port is fluidly connected to the coating fluid chamber when the barrel is assembled to a compatible spray gun platform.

Embodiment 8

The barrel of any of Embodiments 1 to 7 wherein the boost passageway is not interrupted by a shut-off device.

Embodiment 9

An assembly comprising a barrel and a coating fluid reservoir adapted for use in combination with a spray gun;

the barrel comprising

- a fluid interface adapted to connect the barrel to the coating fluid reservoir, the fluid interface comprising a fluid port;
- a fluid nozzle opening through which a fluid to be sprayed can exit the barrel, the fluid nozzle opening being fluidly connected to the fluid port by a fluid passageway formed within the barrel;
- a gun interface adapted to connect the barrel to a spray gun platform;
- a boost feed port proximate the gun interface;

the coating fluid reservoir being connected to the fluid interface and comprising

- a coating fluid chamber fluidly connected to the fluid port; and
- a boost fluid chamber fluidly connected to the boost delivery port;

a boost passageway fluidly connecting the boost feed port to a boost delivery port located proximate the fluid interface, the boost passageway being formed within the barrel;

wherein the boost passageway is adapted to convey a pressurized boost fluid originating in the spray gun to the boost fluid chamber to assist in urging a fluid in the coating fluid chamber into the fluid passageway and out of the fluid nozzle opening.

Embodiment 10

The assembly of Embodiment 9 wherein the boost passageway is at least partially created by the assembled combination of the barrel and the coating fluid reservoir.

Embodiment 11

The assembly of Embodiment 9 wherein the boost delivery port is integral with the fluid interface, such that the boost passageway is integrally formed as a feature of the barrel.

Embodiment 12

The assembly of any of Embodiments 9 to 11 wherein the coating fluid reservoir comprises a separating member to fluidly separate the coating fluid chamber from the boost fluid chamber.

Embodiment 13

The assembly of any of Embodiments 9 to 12 wherein the boost passageway is not interrupted by a shut-off device.

Embodiment 14

The assembly of any of Embodiments 9 to 13 wherein a fluid in the coating fluid reservoir is prevented from entering the boost passageway regardless of the orientation of the coating fluid reservoir with respect to the barrel.

Embodiment 15

An assembly comprising a barrel and a spray gun
the barrel comprising
- a fluid interface adapted to connect the barrel to a coating fluid reservoir, the fluid interface comprising a fluid port;
- a fluid nozzle opening through which a fluid to be sprayed can exit the barrel, the fluid nozzle opening being fluidly connected to the fluid port by a fluid passageway formed within the barrel;
- a gun interface adapted to connect the barrel to a spray gun;
- a boost feed port proximate the gun interface and fluidly connected to a boost passageway formed within the barrel;

the spray gun comprising a boost port housed within a barrel interface, the spray gun being connected to the gun interface at the barrel interface;
- wherein the boost passageway is adapted to convey a pressurized boost fluid originating from the boost port to a boost delivery port proximate the fluid interface to assist in urging a fluid in a compatible coating fluid reservoir into the fluid passageway and out of the fluid nozzle opening.

Embodiment 16

A coating fluid reservoir adapted for connection to a compatible barrel of a spray gun, the coating fluid reservoir comprising
- a coating fluid chamber; and
- a boost fluid chamber separated from the coating fluid chamber by a separating member;
- a lid member comprising
  - a reservoir connector for connection of the coating fluid reservoir to a compatible barrel;
  - a fluid aperture fluidly connected to the coating fluid chamber; and
  - a boost aperture fluidly connected to the boost fluid chamber;

wherein introduction of a pressurized boost fluid to the boost fluid chamber via the boost aperture causes application of pressure to the coating fluid chamber to urge a fluid in the coating fluid chamber through the fluid aperture.

Embodiment 17

The coating fluid reservoir of Embodiment 16 wherein the fluid aperture comprises a central passage surrounding an aperture axis, and the boost aperture is positioned adjacent the fluid aperture a first distance from the aperture axis.

Embodiment 18

The coating fluid reservoir of any of Embodiments 16 to 17 wherein the boost aperture comprises a at least one aperture surrounding the fluid aperture.

Embodiment 19

The coating fluid reservoir of any of Embodiments 16 to 18 wherein the fluid aperture is defined by an axial passage through a coupling protrusion, the coupling protrusion comprising a protrusion mating surface configured to seal against a compatible barrel of a spray gun.

Embodiment 20

The coating fluid reservoir of Embodiment 19 wherein the boost aperture comprises a plurality of apertures surrounding the coupling protrusion.

Embodiment 21

The coating fluid reservoir of any of Embodiments 16-20 wherein the lid member further comprises a reservoir connector comprising a retention member adapted to retain the lid member on a compatible barrel.

Embodiment 22

The coating fluid reservoir of any of Embodiments 16-21 wherein the separating member comprises a compressible pouch surrounding the coating fluid chamber.

Embodiment 23

The coating fluid reservoir of any of Embodiments 16-22 wherein the boost fluid chamber surrounds the coating fluid chamber.

Embodiment 24

The coating fluid reservoir of any of Embodiments 16-22 wherein the boost fluid chamber is surrounded by an outer housing.

Embodiment 25

The coating fluid reservoir of Embodiment 24 wherein the outer housing comprises the lid member and a separable cup member.

Embodiment 26

The coating fluid reservoir of Embodiment 25 wherein the lid member is joined to the separable cup member by a collar.

Embodiment 27

The coating fluid reservoir of Embodiment 24 wherein the lid member is integral with and forms one end of the outer housing.

Embodiment 28

The coating fluid reservoir of any of Embodiments 16-27 comprising a fluid aperture sealing member adapted to fluidly isolate the fluid aperture from the boost aperture upon connection of the coating fluid reservoir to a compatible barrel.

Embodiment 29

The coating fluid reservoir of any of Embodiments 16-28 comprising a boost aperture sealing member adapted to fluidly isolate the boost aperture from an ambient atmosphere upon connection of the coating fluid reservoir to a compatible barrel.

Embodiment 30

A spray gun comprising a spray gun platform, the spray gun platform comprising a barrel interface adapted for connection of a separable barrel, an fluid inlet, and a trigger valve, the barrel interface comprising a boost port that is in fluid communication with the fluid inlet upon actuation of the trigger valve.

Embodiment 31

A spray gun comprising a spray gun platform, the spray gun platform comprising a barrel, the barrel comprising a boost passageway, a fluid passageway, and a fluid interface, the fluid interface comprising a boost delivery port in fluid communication with the boost passageway and a fluid port in fluid communication with the fluid passageway.

Embodiment 32

The spray gun of Embodiment 31 further comprising an fluid inlet and a trigger valve, wherein the boost delivery port is in fluid communication with the fluid inlet upon actuation of the trigger valve.

Embodiment 33

The spray gun of any of Embodiments 31-32 wherein the barrel is integral with the spray gun platform.

Embodiment 34

The spray gun of any of Embodiments 31-32 wherein the barrel is separable from the spray gun platform and wherein the barrel comprises a gun interface and the spray gun platform comprises a barrel interface, the gun interface being releasably connected to the barrel interface.

Embodiment 35

The spray gun of any of Embodiments 31-34 further comprising a coating fluid reservoir connected to the fluid interface.

Embodiment 36

The spray gun of Embodiment 35 wherein the coating fluid reservoir comprises a boost aperture in fluid communication with the boost delivery port, and a fluid aperture in fluid communication with the fluid port.

Embodiment 37

The spray gun of Embodiment 36 wherein the coating fluid reservoir comprises a boost fluid chamber in fluid communication with the boost aperture and a coating fluid chamber in fluid communication with the fluid aperture.

Embodiment 38

The spray gun of Embodiment 37 wherein the coating fluid reservoir comprises a separating member fluidly isolating the boost fluid chamber from the coating fluid chamber.

Embodiment 39

A pouch for assembly into a compatible barrel, the pouch comprising:

a separating member surrounding a coating fluid chamber;

a fluid aperture in fluid communication with the coating fluid chamber;

a coupling protrusion proximate the fluid aperture and comprising one or more protrusion mating surfaces adapted to seal against one or more cooperating barrel mating surfaces in the barrel.

These and other aspects of the invention will be apparent from the detailed description below. In no event, however, should the above summaries be construed as limitations on the claimed subject matter, which subject matter is defined solely by the attached claims, as may be amended during prosecution.

BRIEF DESCRIPTION OF THE DRAWINGS

Throughout the specification, reference is made to the appended drawings, where like reference numerals designate like elements, and wherein.

DETAILED DESCRIPTION

Figure 1:
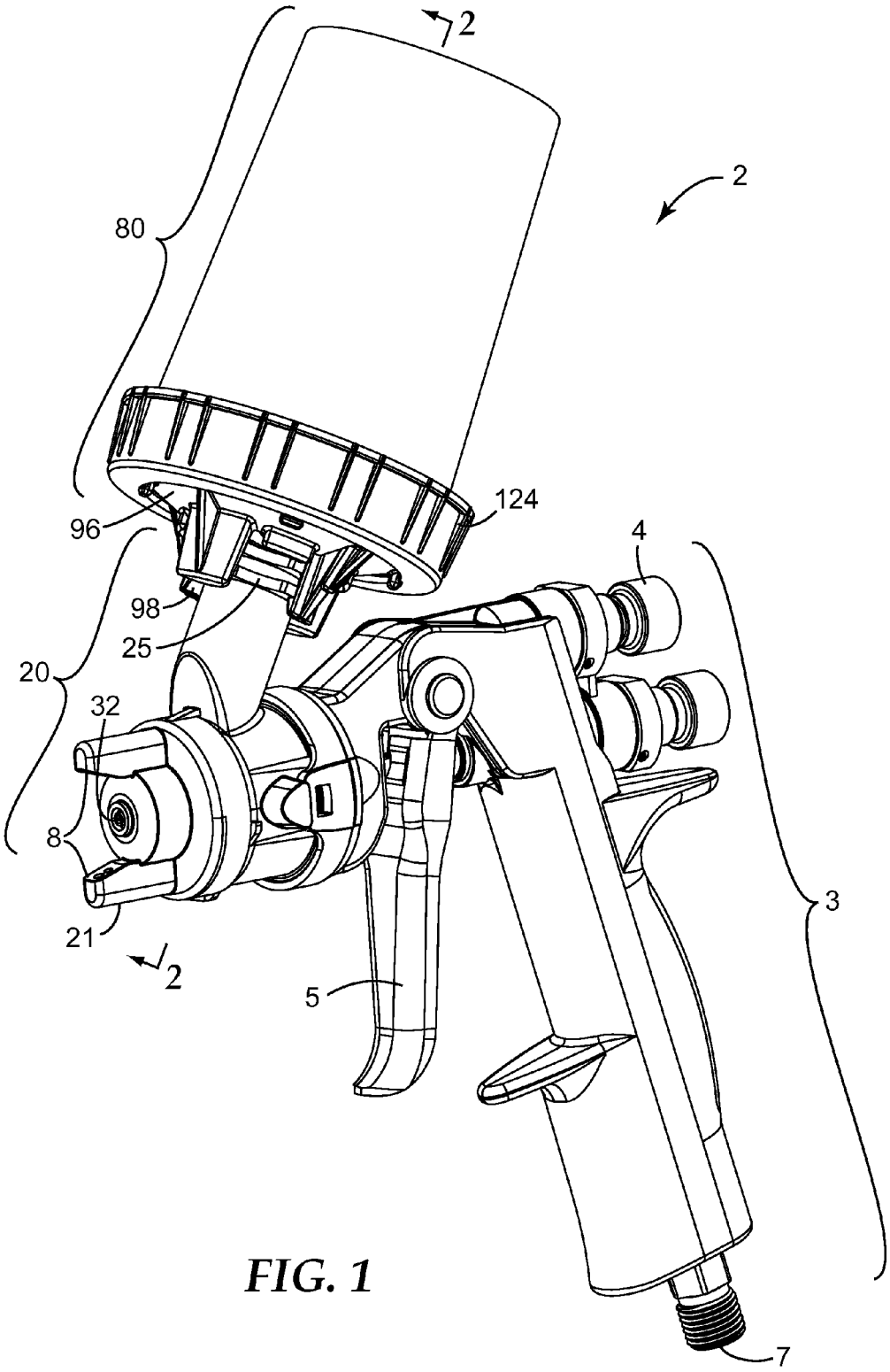
FIG. 1 depicts a perspective view of an exemplary spray gun according to the present disclosure.
Figure 2:
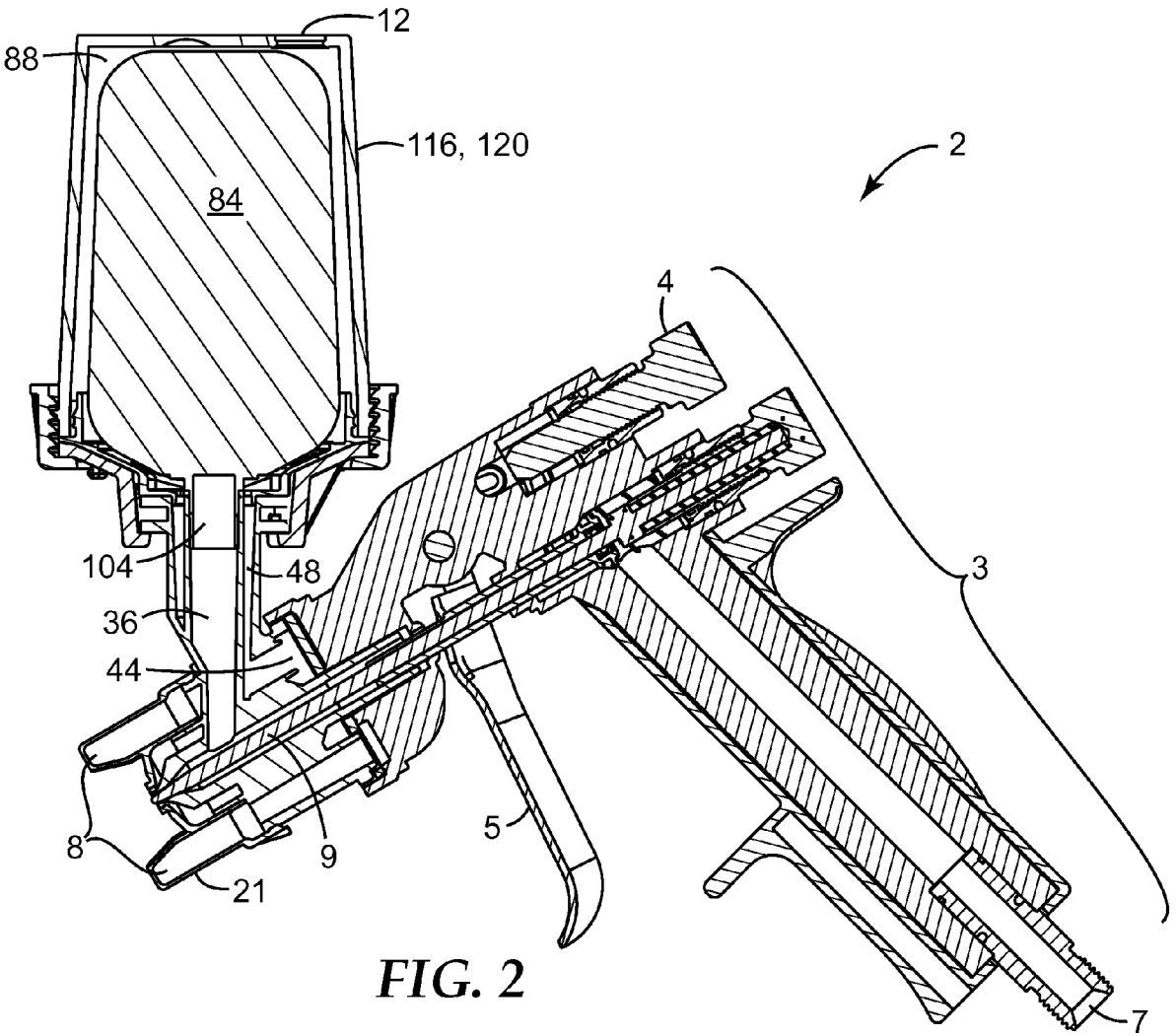
FIG. 2 depicts a cross-section view taken at 2-2 of FIG. 1 of an exemplary spray gun according to the present disclosure.

Referring to FIGS. 1-2, an exemplary spray gun 2 is shown comprising a spray gun platform 3, a separable barrel 20 connected to the spray gun platform 3, and a coating fluid reservoir 80 connected to the barrel 20. The barrel 20 comprises a gun interface 40 that connects to a barrel interface 10 on the spray gun platform 3. The barrel 20 further comprises a fluid interface 24 that connects to a reservoir connector 100 on the coating fluid reservoir 80. As shown, the fluid interface 24 comprises a barrel connector 25 to which retention member 98 of the reservoir connector 100 is releasably connected. As can be seen in FIG. 1, the barrel 20 may comprise an fluid cap 21. The spray gun platform 3 comprises a shaping fluid adjustment 4 adapted to control a flow of shaping fluid from the spray gun platform 3 to the fluid cap 21. The spray gun platform 3 further comprises a trigger actuator 5 adapted to actuate a trigger valve 6 (shown schematically throughout, for example, FIGS. 16A-17B) to switch a flow of inlet fluid entering an fluid inlet 7 on the spray gun platform 3.

Figure 1A:
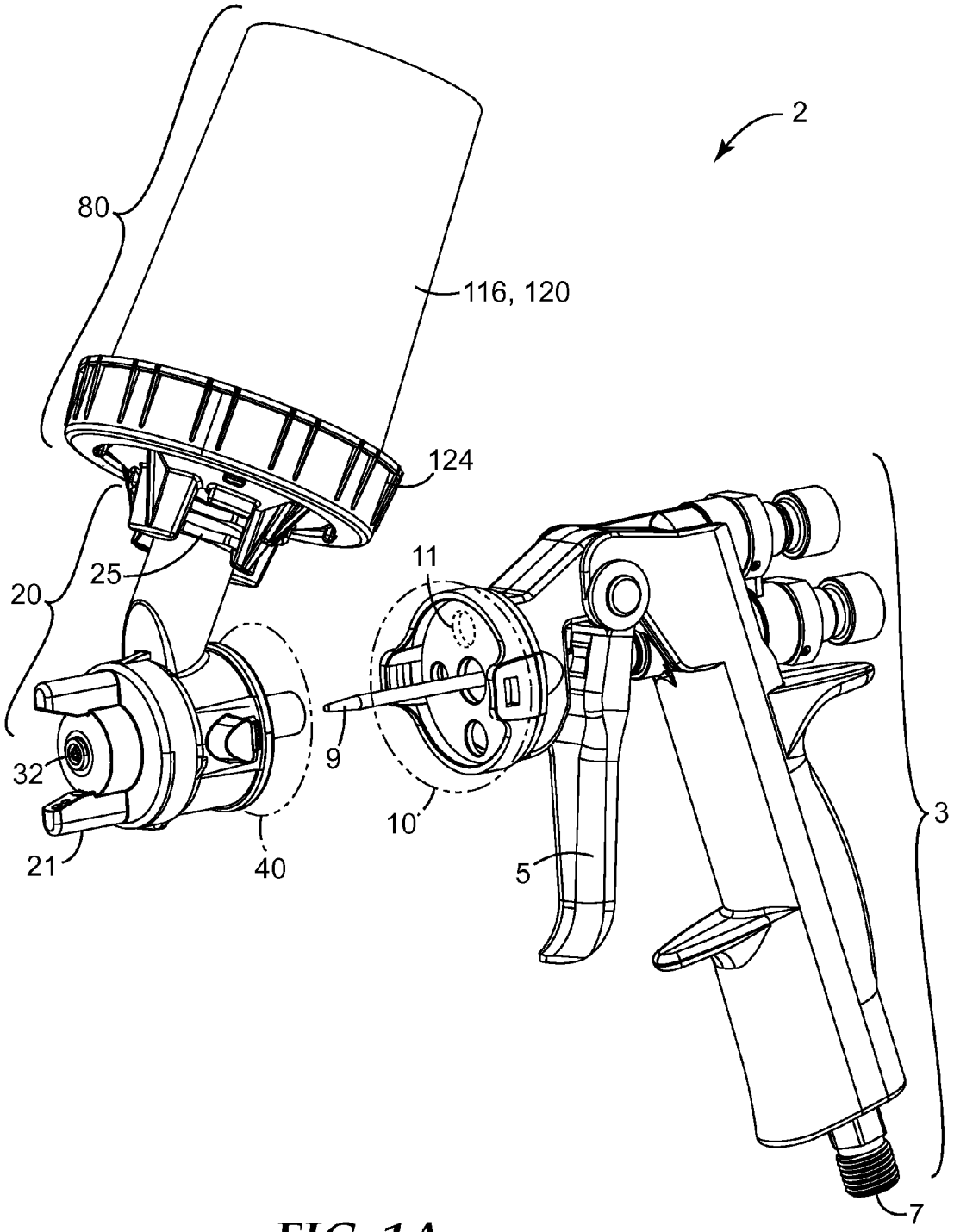
FIG. 1A depicts an exploded perspective view of an exemplary spray gun according to the present disclosure.

As better visualized by reference to FIGS. 1A and 2, when inlet fluid is permitted to flow through the actuated trigger valve 6, a portion of the inlet fluid is diverted through the shaping fluid adjustment 4 for use as shaping fluid, and another portion is diverted through the gun interface 40 to an coating fluid chamber 42 for use as, for example, center fluid surrounding a fluid nozzle opening 32 on the barrel 20. As is known in the art, the center fluid is adapted to atomize and propel a coating fluid 60 flowing through the fluid nozzle opening 32 in a conical pattern, while the shaping fluid exits from a pfluid of fluid horns 8 to shape the conical pattern into an elongated pattern, such as an oval or an ellipse. It should be noted that, due to complexities in the design of the spray gun platform 3 shown in FIG. 2, not all of the various flow paths can be fully shown in a single cross section. Further description of spray gun features suitable for use with embodiments herein can be found in U.S. Pat. Pub. No. 2010/0187333 A1 to Escoto, Jr., et al., the disclosure of which is hereby incorporated by reference in its entirety (see, e.g., reference number 10 therein, along with associated figures and description).

In addition to the above flow paths, the cross section of FIG. 2 depicts a boost passageway 48 within the barrel 20 adapted to carry a boost fluid 52 originating in the spray gun platform 3 to a boost fluid chamber 88 in the coating fluid reservoir 80. As shown, a boost feed port 44 is formed within the coating fluid chamber 42, thus diverting fluid from the coating fluid chamber 42 for use as boost fluid 52. The boost fluid 52 can flow, then, through the boost feed port 44, into a boost passageway 48 in the barrel 20, through a boost delivery port 56 proximate the fluid interface 24, and eventually through a boost aperture 108 (shown more clearly, for example, in FIGS. 4 and 5) in the coating fluid reservoir 80 and into a boost fluid chamber 88. In some embodiments, the boost feed port 44 connects directly to a boost port 11 on the spray gun platform 3 (i.e., rather than pulling fluid from the coating fluid chamber 42). In such embodiments, a boost port sealing member 13 (see, e.g., FIGS. 16D and 16E) may be optionally provided on either or both the boost feed port 44 or the boost port 11. Such boost port sealing member 13 may comprise any suitable sealing material, such as those disclosed elsewhere herein. Where used, a boost port 11 can provide a separate, dedicated fluid path for a boost fluid 52 originating in the spray gun platform 3. Such boost port 11 can comprise, for example, a socket or a protrusion, or any other feature suitable for providing isolated fluid communication of a boost fluid 52 in cooperation with a compatible boost feed port 44 on a barrel 20.

In some embodiments, the flow rate of a boost fluid 52 entering the boost fluid chamber 88 can be regulated by a boost variable flow control 50 (shown schematically in, for example, FIGS. 16B-16E and 17B). A boost variable flow control 50 can assist in adjusting the degree of "push" provided by the boost fluid 52 for different applications. For example, it may be advantageous to alter the flow of boost fluid 52 where differing viscosities of coating fluids are used. Similarly, where differing rates of application of coating fluid 60 are used, it may be advantageous to vary the rate of boost fluid 52 flow. In most situations, the boost fluid 52 flow rate should be at least enough to maintain steady pressure in the boost chamber as a coating fluid 60 leaves the coating fluid chamber 84.

The boost variable flow control 50, when included, may comprise any suitable variable flow control mechanism such a needle valve or other variable orifice. The boost variable flow control 50 may be included in any location on the spray gun 2 that is functionally upstream of the boost fluid chamber 88, but may be advantageously located on a certain readily accessible portion thereof, depending on the gun configuration. For example, in some embodiments, a boost variable flow control 50 is located on the barrel 20 in communication with the boost passageway 48. In other embodiments, the boost variable flow control 50 is located in the coating fluid reservoir 80 to regulate boost fluid 52 entering the boost chamber. In the above two configurations, due to the potential for single or limited duration use, it may be advantageous to provide the boost variable flow control 50 in a form that is relatively inexpensive and disposable. Still in other embodiments, the boost variable flow control 50 is located on the spray gun platform 3. If located on the spray gun platform 3, the boost variable flow control 50 may be constructed to last for the useful life of the spray gun platform 3. For reference, FIGS. 16A-17B and Tables 1 and 2 below describe several alternate configurations for a boost variable flow control 50.

Advantageously, the boost variable flow control 50 need not have the capability to act as a shut-off device for the boost fluid 52 and can be omitted entirely. This is because, as a result of the coating fluid 60 being confined to a coating fluid chamber 84 that is fluidly isolated from the boost fluid chamber 88, there is no risk of a coating fluid 60 running into the boost passageway 48 from the coating fluid reservoir 80.

In the absence of a boost variable flow control 50 valve, the flow of boost fluid 52 can be regulated or maintained within suitable operating levels by other means such as a fixed orifice or simply by choice of appropriate fluid conduit sizes. In some embodiments, no specific means of regulating boost fluid 52 flow is required, as simple unregulated diversion of fluid sourced from the spray gun platform 3 will suffice. This may be particularly true where fluid entering the fluid inlet 7 is already regulated by means of a device such as a pressure regulator.

Figure 5:
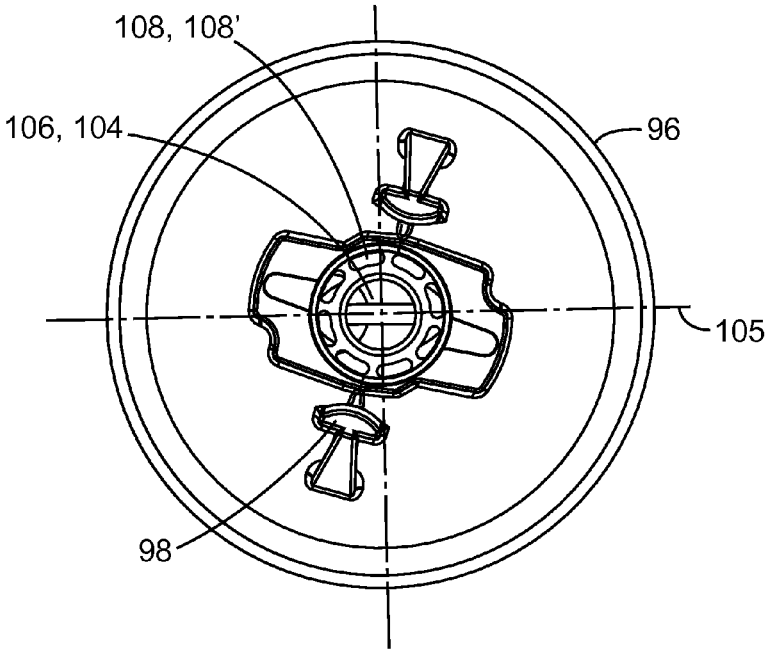
FIG. 5 depicts a plan view of an exemplary lid member according to the present disclosure.
Figure 6:
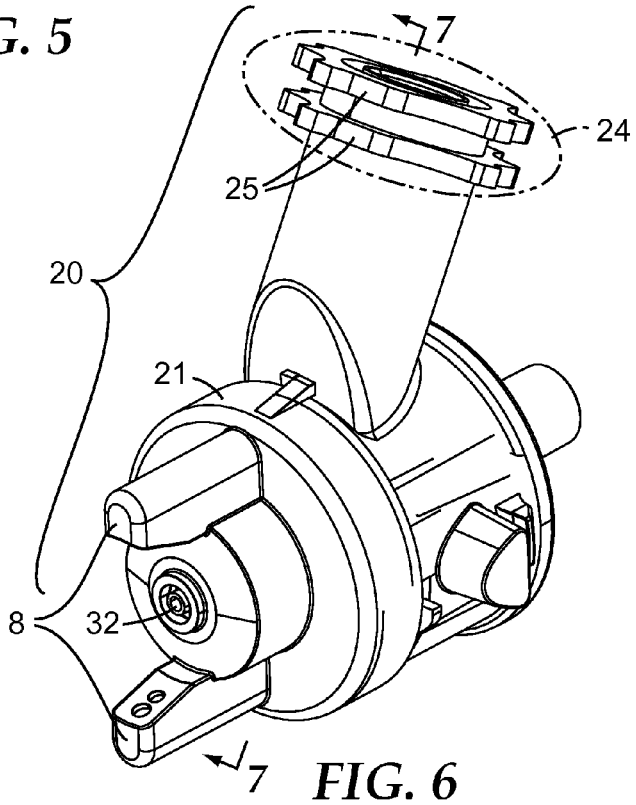
FIG. 6 depicts a perspective view of an exemplary barrel and fluid cap assembly according to the present disclosure.
Figure 7:
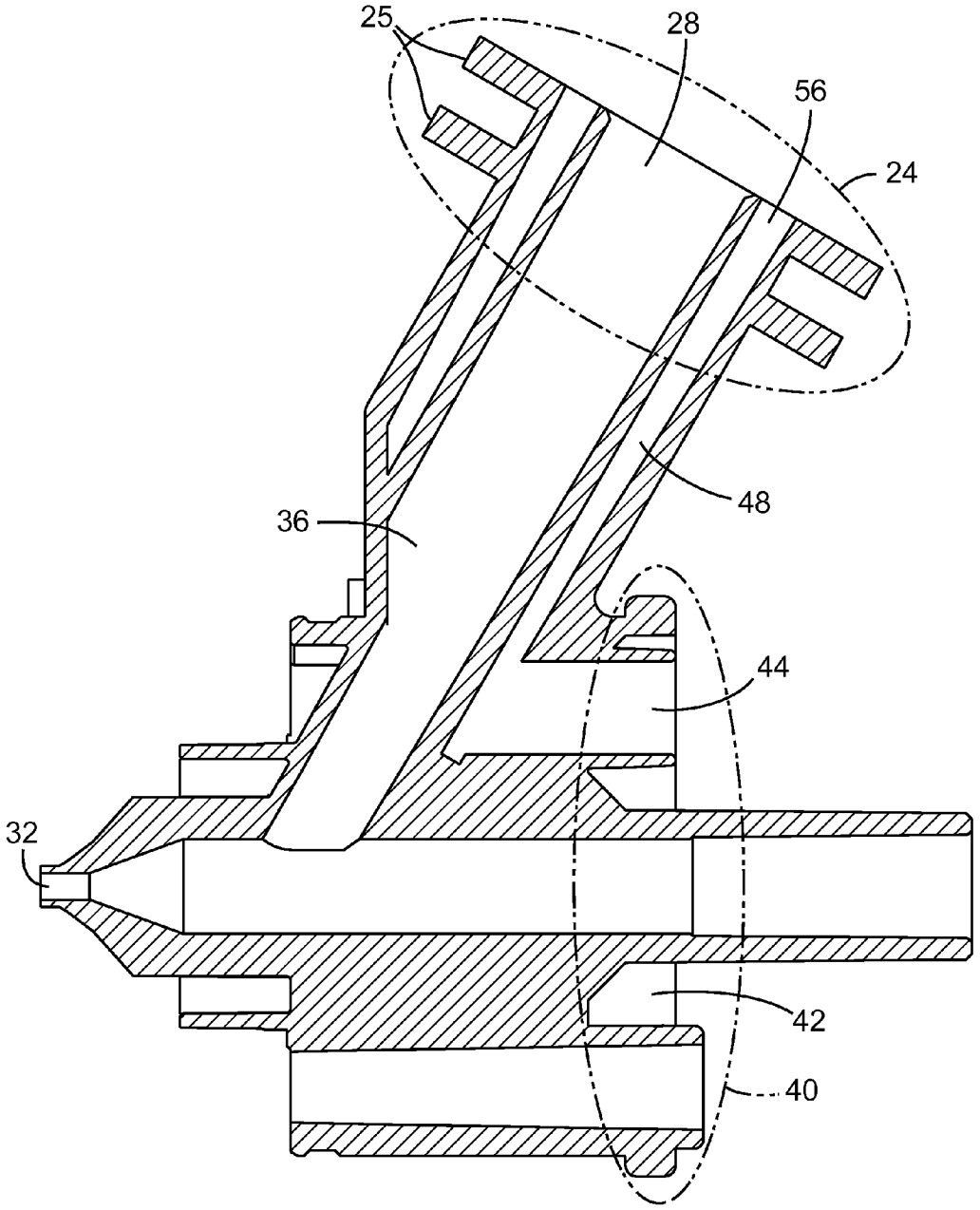
FIG. 7 depicts a cross-section view taken at 7-7 of FIG. 6 of an exemplary barrel according to the present disclosure.
Figure 8:
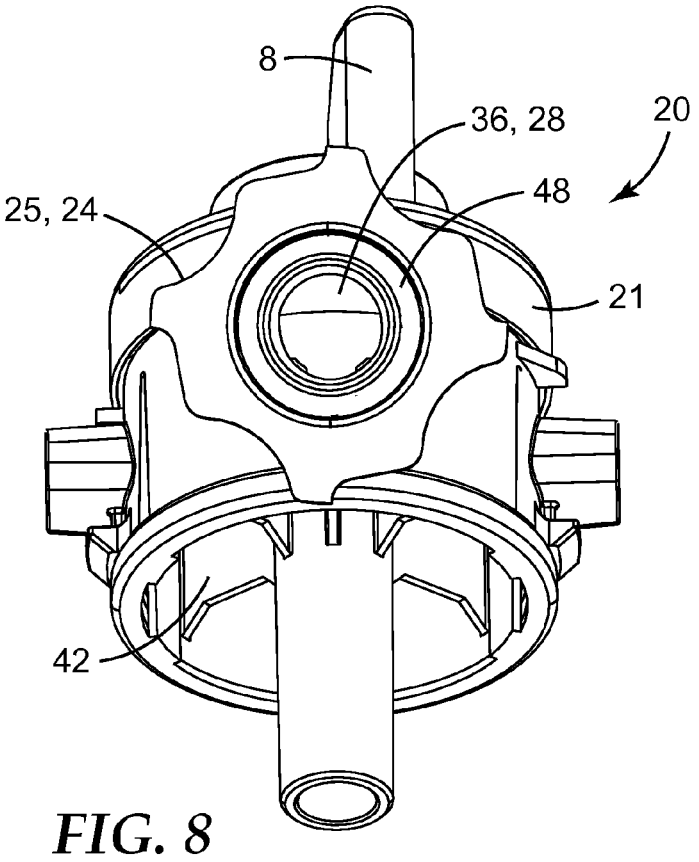
FIG. 8 depicts a plan view of an exemplary fluid interface of a barrel according to the present disclosure.
Figure 9:
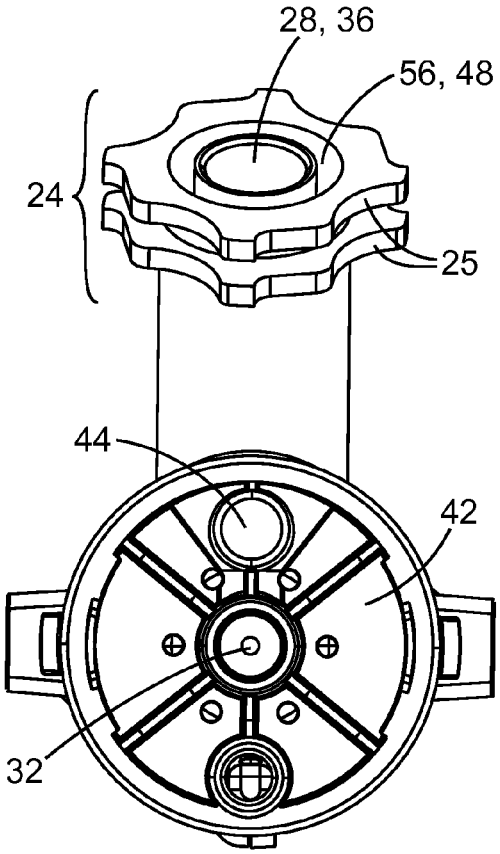
FIG. 9 depicts a plan view of an exemplary gun interface of a barrel according to the present disclosure.

FIG. 5 depicts an exemplary lid member 96 of a coating fluid reservoir 80 as viewed along an aperture axis 105. In this view, an exemplary boost aperture 108 and fluid aperture 104 are more clearly shown. As shown, the fluid aperture 104 comprises a central passage 106, and the boost aperture 108 comprises a plurality of boost apertures 108' surrounding the fluid aperture 104 in the manner of a ring. The central passage 106 surrounds an aperture axis 105, and the boost aperture 108 is positioned adjacent the fluid aperture 104 a first distance from the aperture axis 105.

Referring to FIGS. 6-9, the fluid interface 24 of the barrel 20 comprises a fluid port 28 to fluidly connect with the fluid aperture 104, and a boost delivery port 56 to fluidly with the boost aperture 108. As shown, the boost delivery port 56 comprises an annulus that corresponds in shape to the arrangement of boost apertures 108' in the coating fluid reservoir 80.

Any manner of sealing mechanism may be employed to ensure fluid isolation between the coating fluid passageway 36 and the boost passageway 48, and between the boost passageway 48 and an ambient atmosphere. For example, tightly fitting parts may suffice, particularly where relatively low fluid pressure are employed. As schematically shown throughout FIGS. 16A-17B, sealing members may be employed at various locations in the assembly. In one embodiment, a fluid aperture sealing member 118 is provided to fluidly isolate the coating fluid passageway 36 from the boost passageway 48 (when the barrel 20 is connected to the coating fluid reservoir 80). In some embodiments, a boost aperture sealing member 119 may be provided to fluidly isolate the boost aperture 108 from the ambient atmosphere (when the barrel 20 is connected to the coating fluid reservoir 80). In some embodiments, both a fluid aperture sealing member 118 and a boost aperture sealing member 119 are provided. The fluid aperture sealing member 118 and/or the boost aperture sealing member 119, if used, may be provided on either or both of the barrel 20 or the coating fluid reservoir 80. Exemplary sealing members include o-rings, gaskets, overmolded polymers (e.g., thermoplastic elastomers such as SANTOPRENE), and the like.

Figure 4:
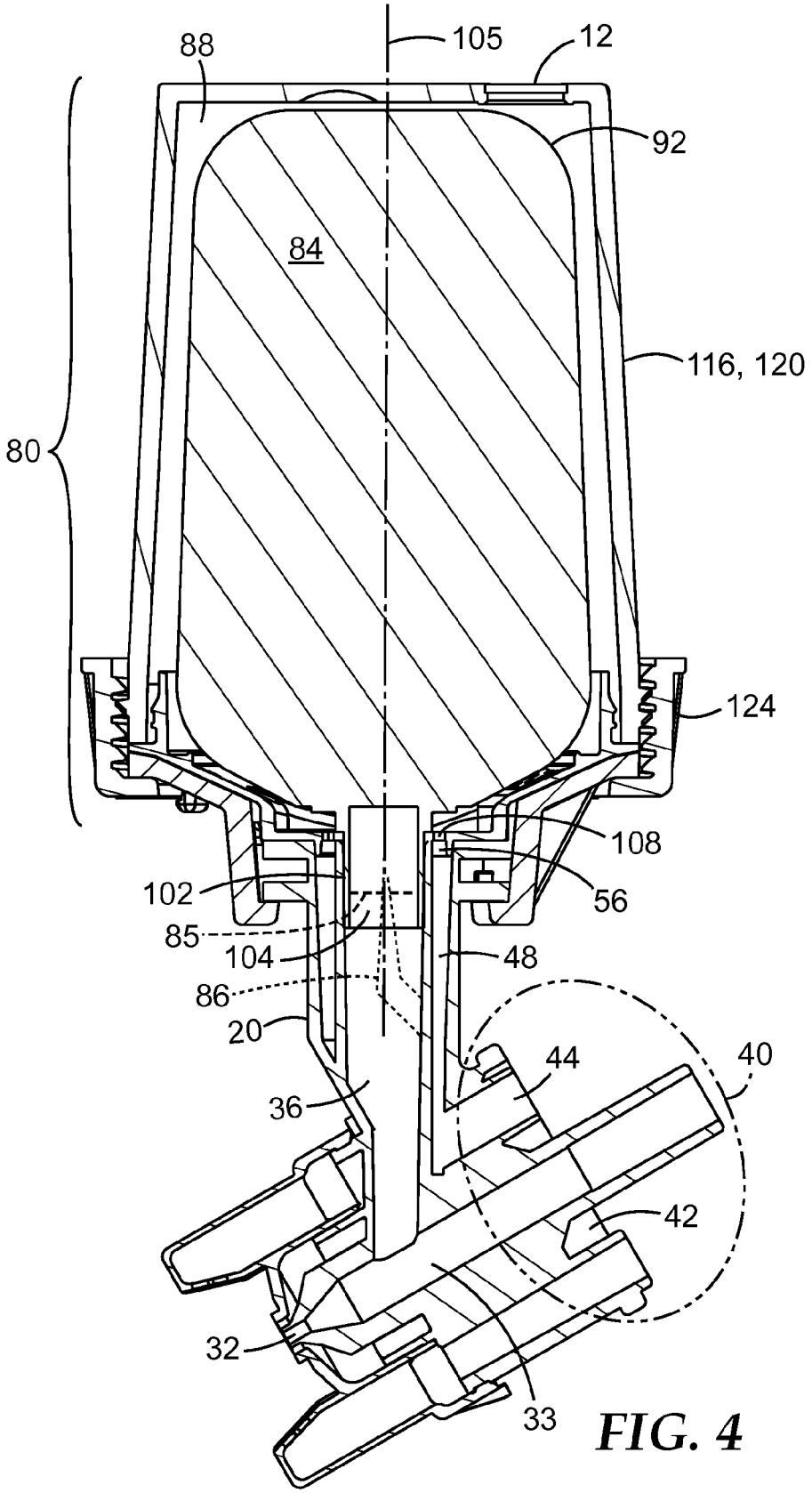
FIG. 4 depicts a cross-section view of an exemplary coating fluid reservoir and barrel assembly as used in the spray gun of FIG. 2.

Greater detail of an exemplary barrel 20 and coating fluid reservoir 80 assembly can be seen in FIG. 4. As shown, the boost feed port 44 opens to the gun interface 40, and the boost passageway 48 connects the boost feed port 44 to the boost delivery port 56 proximate the coating fluid reservoir 80 and the fluid aperture 104. Also visible are an optional shaping coating fluid chamber and fluid needle passageway 33 connecting to the coating fluid passageway 36. When the barrel 20 is connected to a spray gun platform 3 (e.g., as in FIG. 2), the fluid needle 9 is by default positioned to occlude the fluid nozzle opening 32. In order that the barrel 20 sealingly connect to the spray gun platform 3 at the gun interface 40, either or both of the gun interface 40 or the barrel interface 10 may optionally be provided with a gun interface sealing member 41, which may comprise any suitable sealing material, such as those described elsewhere herein. Upon actuation of the trigger valve 6, the fluid needle 9 can in turn be retracted to permit coating fluid 60 to escape from the fluid nozzle opening 32.

Figure 3:
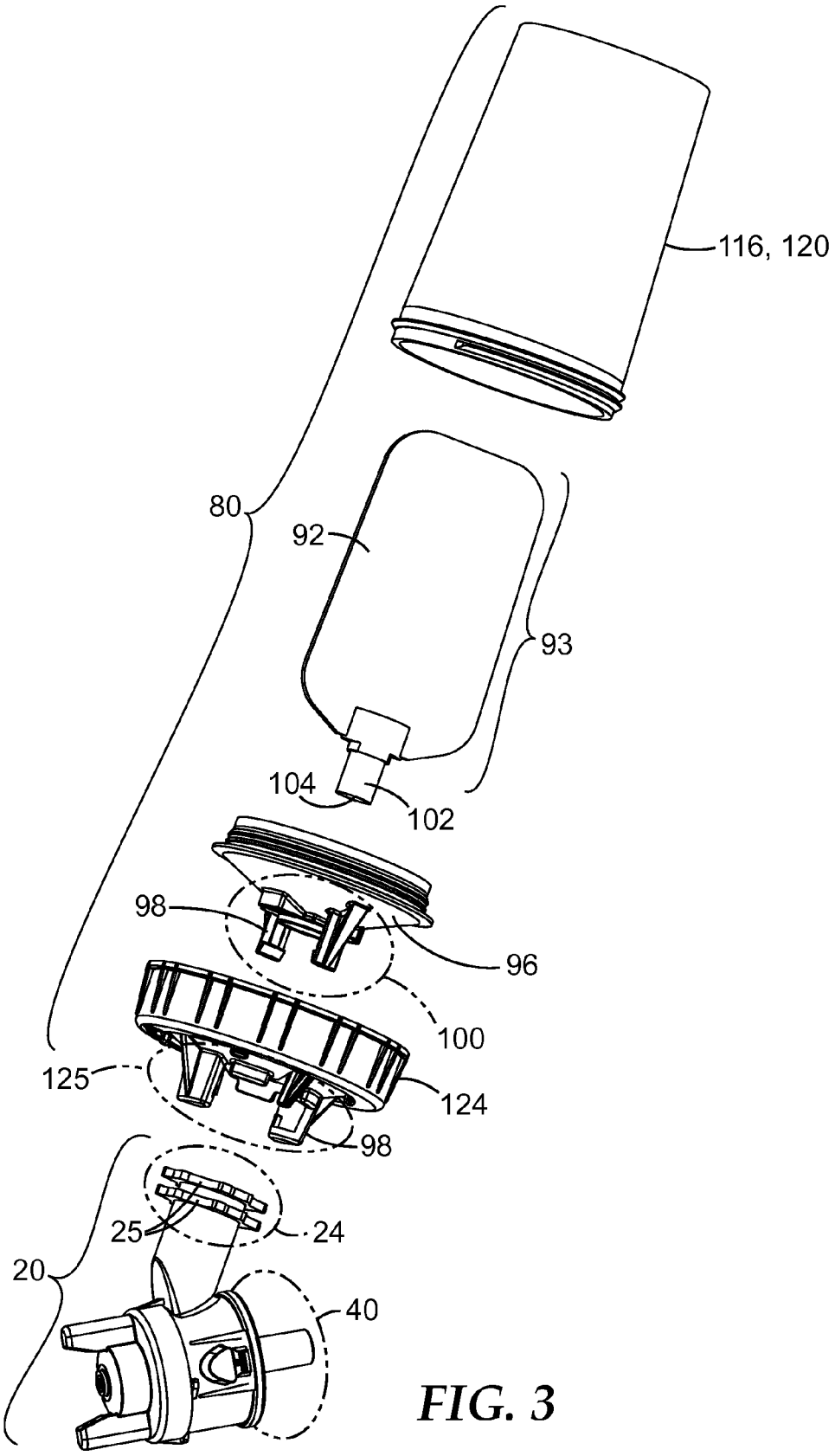
FIGS. 3 and 3A depict exploded perspective views of exemplary coating fluid reservoir and barrel assemblies according to the present disclosure.

The coating fluid reservoir 80 comprises an outer housing 116 comprising a separable cup member 120 closed by a lid member 96. In the embodiment shown in FIG. 3, the lid member 96 is secured to the separable cup member 120 by a collar 124. Where used, the collar 124 may connect to separable cup member 120 by way of threads (as shown), by twist-lock, or any other releasable connection member. As shown, the lid member 96 comprises a reservoir connector 100 and the collar 124 comprises a collar connector 125. The reservoir connector 100 and the collar connector 125 each interact with the fluid interface 24 on the barrel 20 to provide secure connection of the coating fluid reservoir 80 to the barrel 20. Typically, the fluid aperture 104 is located within the reservoir connector 100 to permit a coating fluid 60 to flow from the coating fluid reservoir 80 to the barrel 20. The reservoir connector 100 and/or the collar connector 125, where applicable, may comprise, for example, one or more retention members 98, which may comprise one or more hook members, threads, a twist-lock, or any other releasable connection member configured to releasably connect to a cooperating barrel connector 25 on the fluid interface 24. In the embodiment shown, the reservoir connector 100 is disposed on the lid member 96. In other embodiments, the reservoir connector 100 may be disposed on the outer housing 116 or elsewhere on the coating fluid reservoir 80.

The outer housing 116 may comprise any material or construction suitable for containing a pressurized boost fluid 52 and surrounding a coating fluid chamber 84. For example, the outer housing 116 may comprise rigid or flexible walls. Where a flexible wall is chosen, the outer housing 116 may inflate upon introduction of a pressurized boost fluid 52 into the boost fluid chamber 88. Such inflation may occur to the extent necessary to provide pressure against the coating fluid chamber 84, and need only last until application of coating fluid 60 is complete, after which the flexible walls can be collapsed. A flexible walled outer housing 116 may advantageously consume less space for storage and shipping purposes (due to being collapsible), and may additionally require less material and therefore be lighter and less costly. On the other hand, a rigid walled outer housing 116 may provide increased structure for the coating fluid reservoir 80 such that the coating fluid chamber 84 is well contained and is not prone to flopping or falling over during installation or use. In some embodiments, a hybrid construction may be used, wherein a flexible material is supported at least in part by one or more structural members to assist in providing increased rigidity to the otherwise flexible walls. Such a hybrid construction may advantageously combine benefits of both types of constructions described above. In some embodiments, a separable cup member 120 comprises a flexible wall, but the lid member 96 is rigid. In some embodiments, the separable cup member 120 is rigid, while the lid member 96 is at least partly flexible (i.e., rigid at the reservoir connector 100 to provide a secure connection to the barrel 20, but flexible elsewhere). In some embodiments, both the separable cup member 120 and the lid member 96 are flexible (again, with the lid member 96 being rigid at the reservoir connector 100 to provide a secure connection to the barrel 20, but flexible elsewhere).

Suitable materials for a flexible-walled outer housing 116 include those described herein for use as a separating member 92. Whether rigid or flexible materials are employed for the outer housing 116 or its components, a pressure relief member 12 may be advantageously employed for reasons described herein. The outer housing 116 and its components (whether rigid or flexible) could be transparent, translucent, or opaque, and natural or colored, printed with indicia of source/contents/volume or not—or any combination thereof.

Figure 3A:
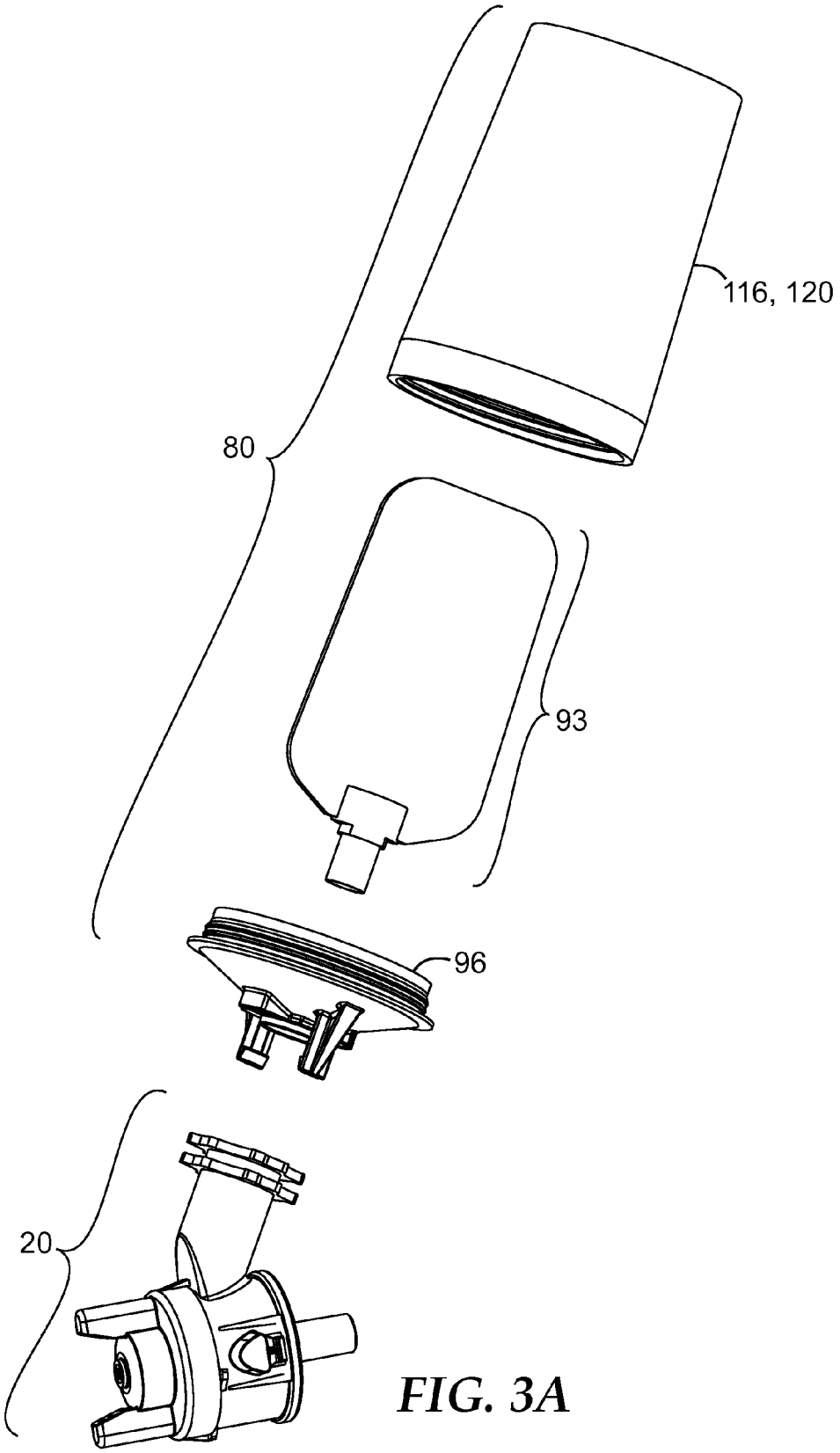

In the alternative embodiment shown in FIG. 3A, the lid member 96 secures directly to the separable cup member 120 without need of a collar 124. Such connection may be by way of threads (as shown), by twist-lock, or any other releasable connection member.

Within the outer housing 116 is a separating member 92 separating a coating fluid chamber 84 from the boost fluid chamber 88. The coating fluid chamber 84 is adapted to be filled with a coating fluid 60. In one embodiment, the coating fluid reservoir 80 (e.g., the outer housing 116, the separable cup member 120, the lid member 96, or the collar 124) comprises a pressure relief member 12 adapted to release boost fluid 52 from the coating fluid reservoir 80 if the boost fluid 52 exceeds a predetermined pressure. In order to ensure proper function of the boost fluid 52 acting upon the coating fluid chamber 84, this predetermined pressure should be selected to be higher than expected operating pressures of the boost fluid 52. Such a pressure relief member 12 is optional.

The separating member 92 may be impermeable to the coating fluid 60, to the boost fluid 52, or to both. In such embodiments, a coating fluid 60 in the coating fluid chamber 84 is fluidly isolated from the boost chamber, and therefore the boost aperture 108. Therefore, the coating fluid 60 is unable to enter the boost passageway 48 where it could be wasted or cause contamination of the gun. This is the case regardless of the orientation of the coating fluid reservoir 80 relative to the spray gun 2. For example, when the filled coating fluid reservoir 80 is oriented above the spray gun 2, gravity will tend to urge the coating fluid 60 to enter the boost passageway 48, but the separating member 92 will keep the coating fluid 60 contained within the coating fluid chamber 84. Said differently, in the absence of the separating member 92, gravity would tend to urge the coating fluid 60 to enter the boost passageway 48.

The separating member 92 may further comprise a material that permits the coating fluid chamber 84 to collapse as the boost fluid 52 applies pressure to an outer surface thereof and coating fluid 60 is expelled through the fluid aperture 104 to be sprayed. In one embodiment, the separating member 92 comprises a thermo/vacuum formed liner member as described, for example, in U.S. Pat. Pub. No. 2004/0256484 to Joseph et al., the disclosure of which is incorporated by reference herein in its entirety (see, e.g., reference number 13 therein, along with associated description and figures). In some embodiments, the separating member 92 comprises a pouch 93, as further described elsewhere in this specification. In any event, the separating member 92 may comprise a single layer or multiple layers of material suitable for achieving the functions described herein.

As noted above, the separating member 92 may comprise a construction that expands or contracts in response to the addition of a pressurized boost fluid into the boost fluid chamber, and thereby modifies the volume of the coating fluid chamber to urge or force coating liquid from the coating liquid chamber. Such expansion and/or contraction may be accomplished in more than one way. For example, the material of the separating member may accommodate an increase in boost fluid chamber volume by stretching, unfolding, un-collapsing, un-crumpling, or by a combination of mechanisms. For example, the separating member may comprise a resiliently expandable material (akin to an elastic rubber balloon) that inflates as the boost fluid chamber volume increases. In such embodiments, the surface area of the separating member material can increase by elastic deformation, plastic deformation, or both, as the boost fluid chamber volume increases. Such embodiments can be likened to a balloon within an enclosing container, wherein the inside of the balloon (i.e., the boost fluid chamber) begins as a small volume, and expands to fill the remaining space (i.e., the coating liquid chamber) within the enclosing container such that a fluid within the remaining space is forced out. In some embodiments, the separating member may be initially folded, collapsed, crumpled, or combinations thereof (e.g., in the manner of a vehicle airbag before it has been deployed), and may respectively unfold, un-collapse, un-crumple, or combinations thereof as the boost fluid chamber volume increases. In such embodiments, the surface area of the separating member material need not (but may, depending on the elasticity of the materials chosen) increase as the boost fluid chamber volume increases.

Moreover, the separating member may comprise a compound construction, wherein at least a portion of the separating member is relatively rigid and non-deformable with respect to other portions of the separating member. For example, the separating member may be constructed to act as a piston within the outer housing, wherein a more rigid portion forms a face of the piston that interfaces with the coating liquid, and other portions of the separating member deform to follow the piston face (e.g., in the manner of accordion bellows, or by elastic or plastic deformation, as described above) as the boost fluid chamber increases in volume. In such embodiments, the more deformable portion (s) of the separating member may be constructed as described in the previous paragraph to stretch, inflate, unfold, un-collapse, un-crumple, or combinations thereof as the boost fluid chamber increases in volume.

In operation, the coating fluid chamber 84 is filled with a coating fluid 60, and the coating fluid reservoir 80 is connected to the barrel 20 of a spray gun 2. As shown, the coating fluid reservoir 80 is connected to the fluid interface 24 of a separable barrel 20. In the connected state, the coating fluid chamber 84 is fluidly connected to the fluid nozzle opening 32 of the barrel 20 via the coating fluid passageway 36, and the boost chamber of the coating fluid reservoir 80 is fluidly connected to the optional boost port 11 of the spray gun 2 via the boost passageway 48. When a pressurized boost fluid 52 is supplied to the boost chamber from the boost port 11, the boost chamber in turn applies pressure to the coating fluid chamber 84 to assist in "squeezing" the coating fluid 60 from the coating fluid chamber 84 and eventually to the fluid nozzle opening 32. Because the boost passageway 48 is routed within the barrel 20, there is no hose or exterior fluid conduit for a user to connect or to interfere with the user's operation of the gun.

In some embodiments, the barrel 20 is separable from the spray gun platform 3. In some embodiments, the barrel 20 is integral with the spray gun platform 3.

Figure 10:
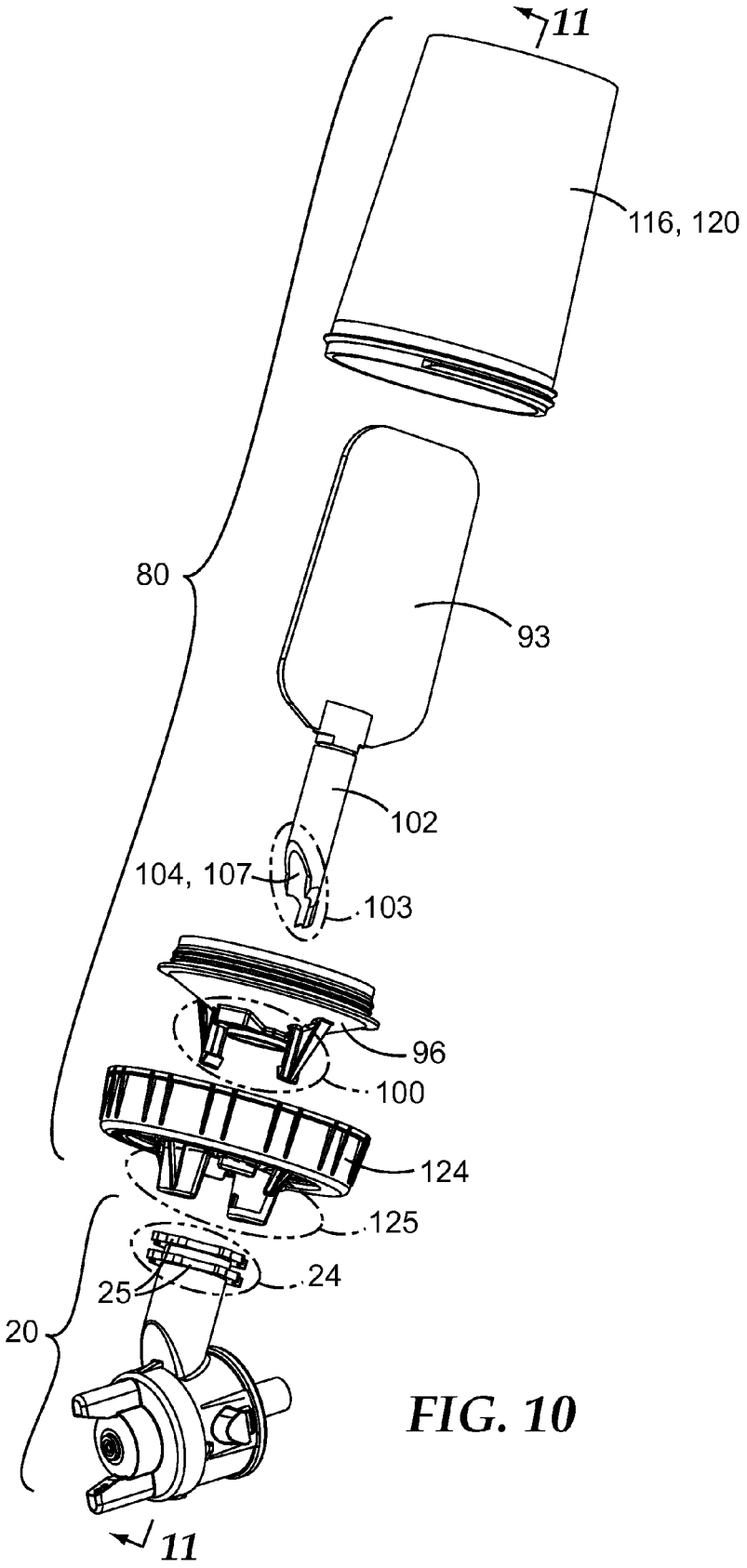
FIG. 10 depicts an exploded perspective view of an exemplary coating fluid reservoir and barrel assembly according to the present disclosure.
Figure 11:
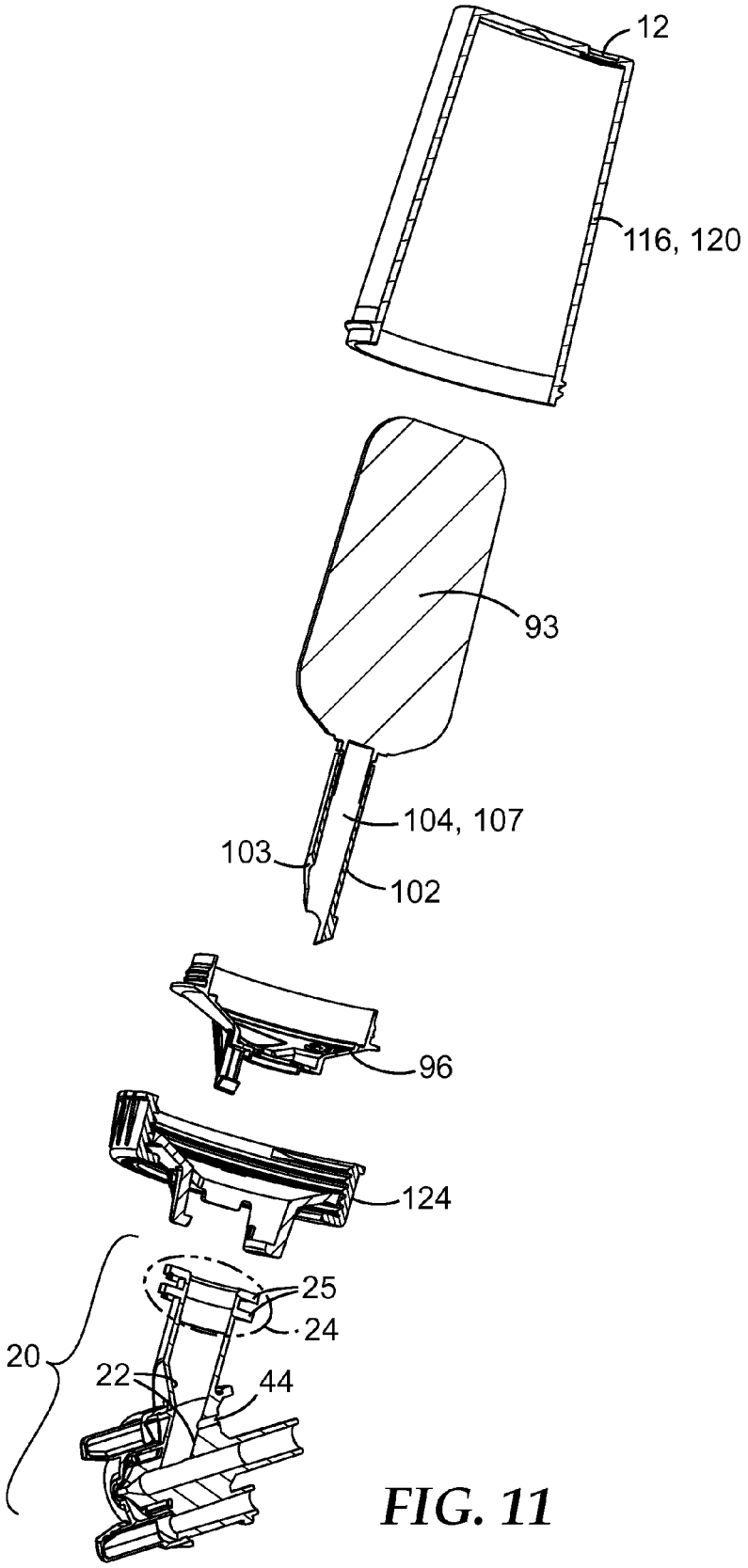
FIG. 11 depicts a perspective cross-section view taken at 11-11 of FIG. 10.
Figure 12:
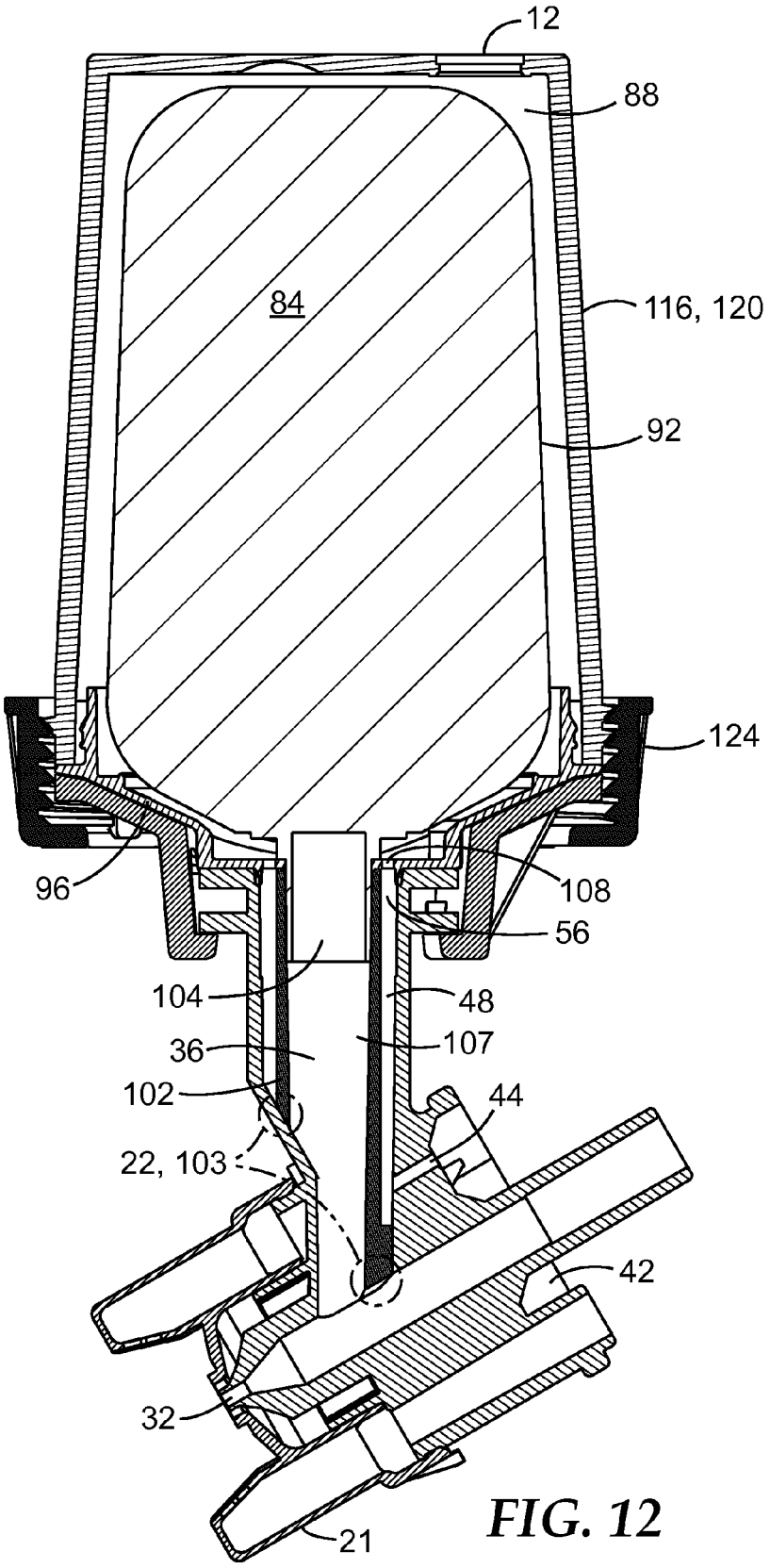
FIG. 12 depicts an assembled cross-section view of the assembly of FIG. 11.

Referring now to FIGS. 10-12, an embodiment is shown wherein a coating fluid chamber 84 comprises a separating member 92 and a coupling protrusion 102 surrounding a fluid aperture 104. As shown, the fluid aperture 104 is defined by an axial passage 107 through the coupling protrusion 102. In this example the separating member 92 comprises a pouch 93, but could be any other separating member 92 contemplated herein. The coupling protrusion 102 cooperates with the barrel 20 such that, when the coating fluid chamber 84 is assembled to the barrel 20, both the coating fluid passageway 36 and the boost passageway 48 are created by the interaction of the components. As can be seen in FIG. 12, once these components are assembled, a boost fluid 52 can be communicated from the boost feed port 44, through the boost passageway 48, through the boost delivery port 56, through a boost aperture 108, and finally into the boost fluid chamber 88. In particular, the coupling protrusion 102 can comprise one or more protrusion mating surfaces 103 adapted to seal against one or more corresponding barrel mating surfaces 22 in the barrel 20 in order to fluidly isolate a boost passageway 48 from a coating fluid passageway 36.

In the embodiment shown, the protrusion mating surfaces 103 and the barrel mating surfaces 22 are somewhat complex. However, it is envisioned that such surfaces could more simply cooperate to result in, for example, a piston seal or a face seal. For example, the protrusion mating surface may comprise the outer surface of a cylinder, while the barrel 20 mating surface may comprise a cooperating inner wall of a cylindrical socket. A sealing member may be provided to correspond to either or both of the protrusion mating surface(s) and the barrel 20 mating surface(s). Exemplary sealing members include o-rings, gaskets, overmolded polymers (e.g., thermoplastic elastomers such as SANTOPRENE), and the like.

The coupling protrusion 102 may formed as an integral feature of a cap member 94, or may be connected (such as by a press fit) to a cap member 94. See, for example, FIG. 11, where the coupling protrusion 102 is a tube that fits over a cap member 94 (number not labeled in this figure) on the pouch 93. In other embodiments, the coupling protrusion may assemble to, or be integral with, a lid member 96.

Figure 13:
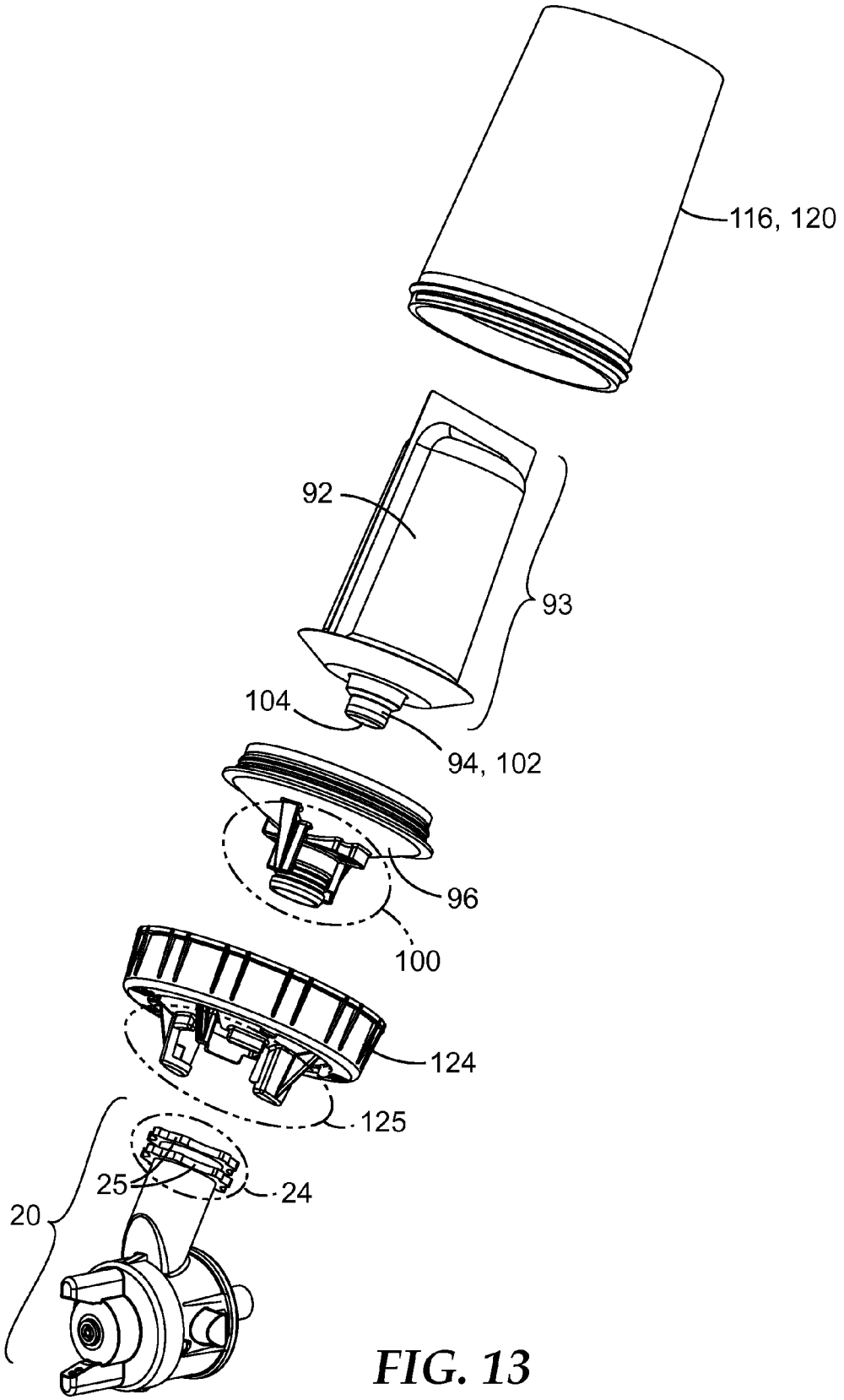
FIG. 13 depicts an exploded perspective view of an exemplary coating fluid reservoir and barrel assembly according to the present disclosure.
Figure 14:
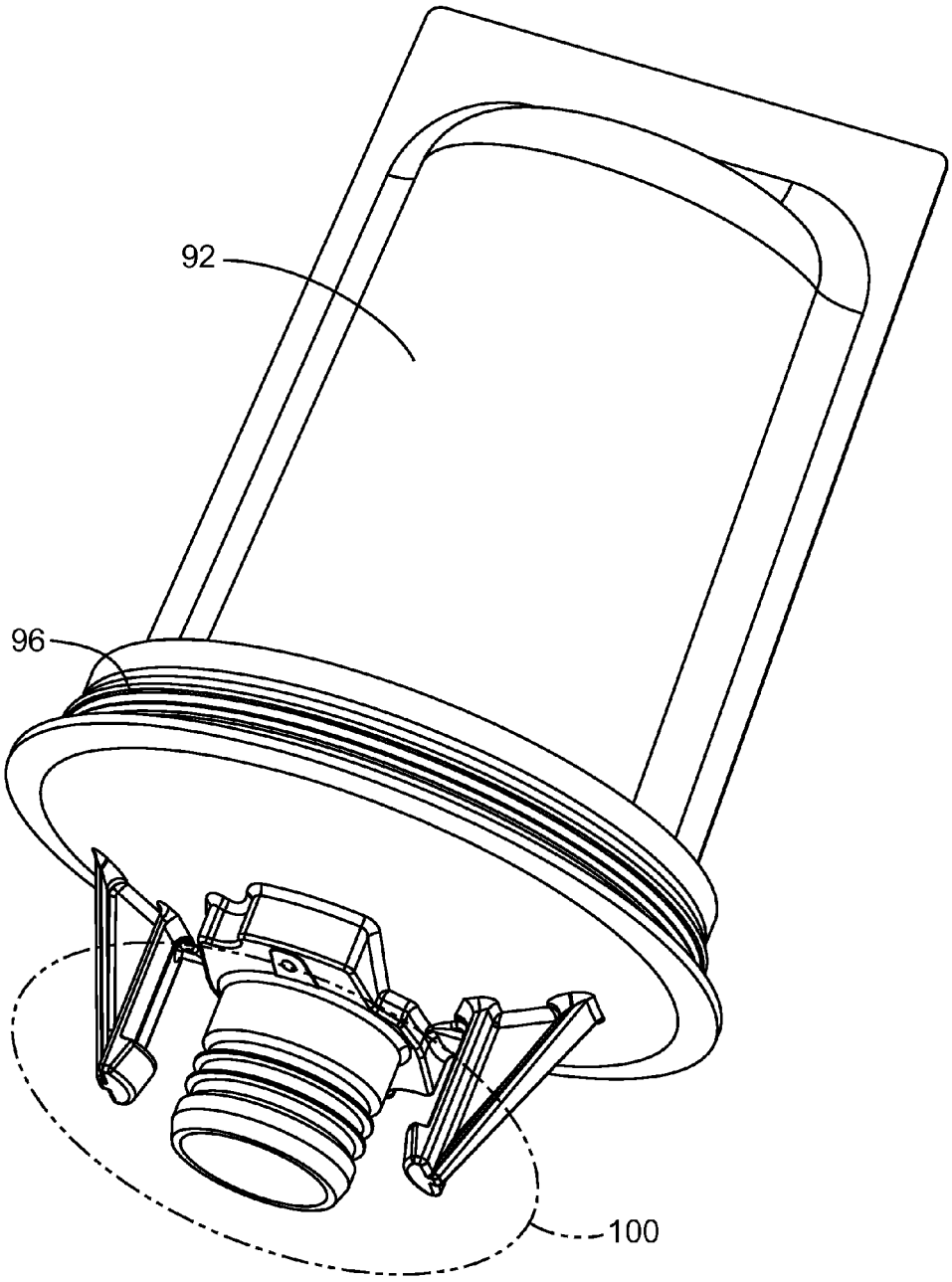
FIG. 14 depicts a perspective view of an exemplary pouch and lid member assembly according to the present disclosure.
Figure 15:
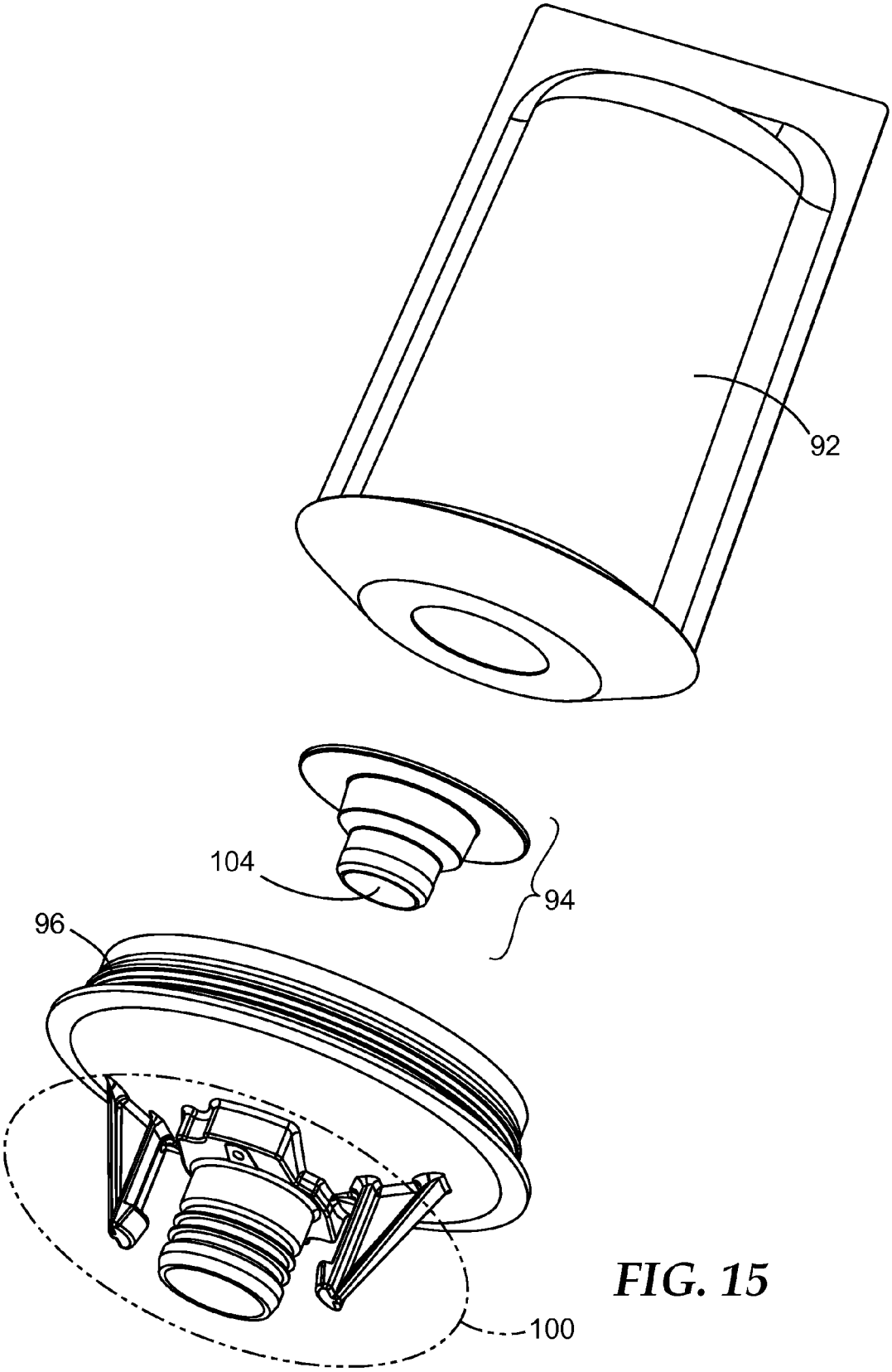
FIG. 15 depicts an exploded perspective view of the assembly of FIG. 14.
Figure 16A:
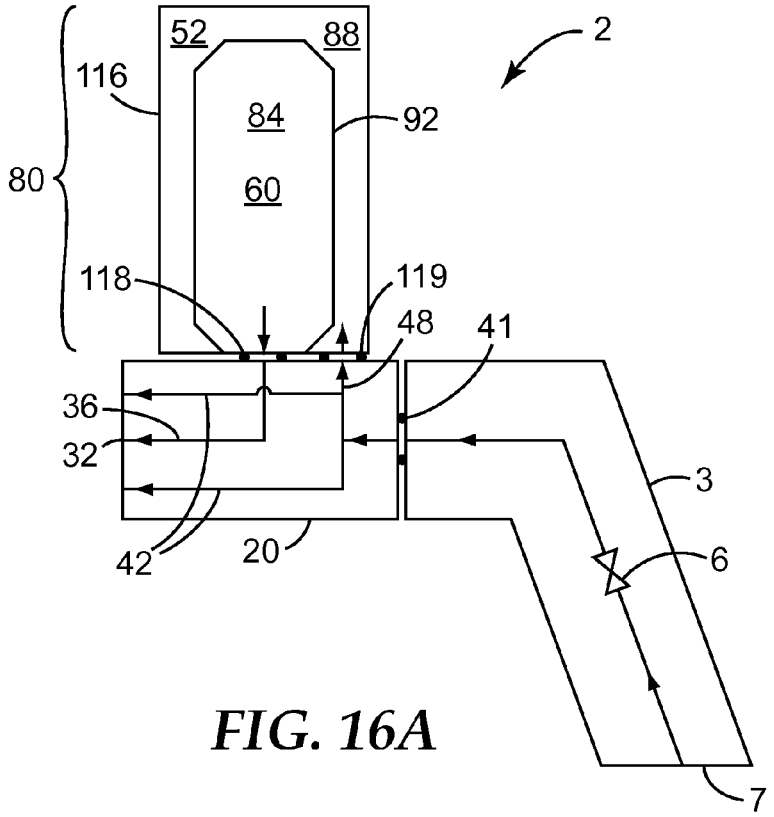
FIGS. 16A-16E depict schematic views of exemplary spray guns comprising separable barrels according to the present disclosure.
Figure 16B:
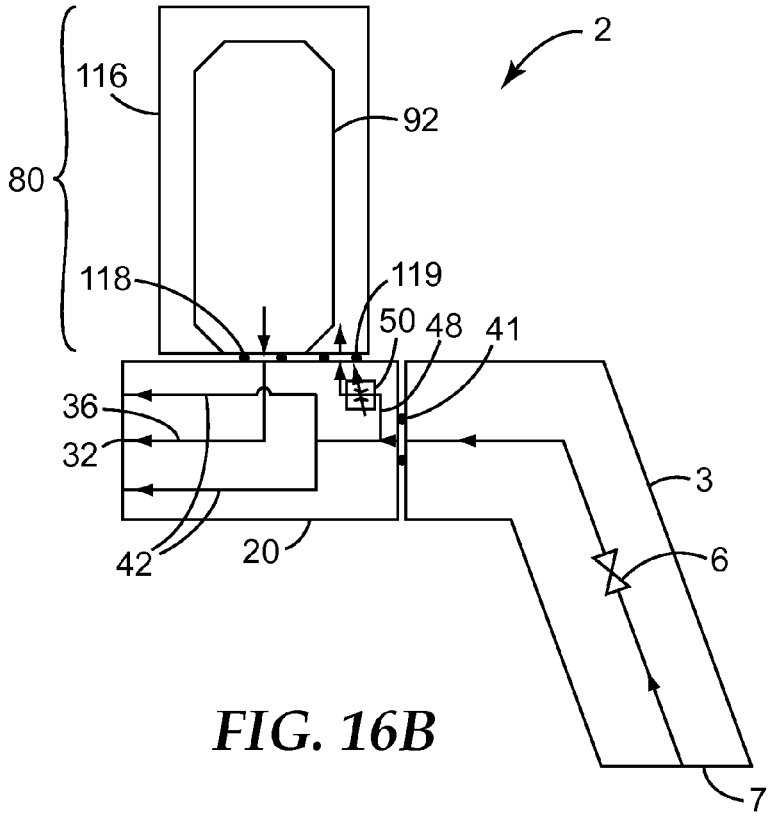
Figure 16C:
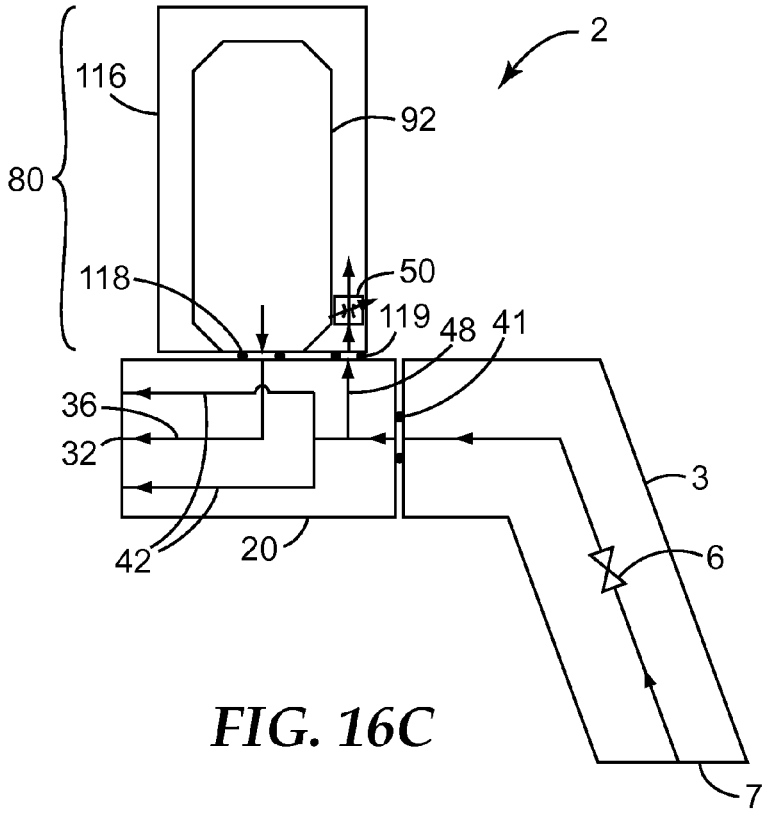
Figure 16D:
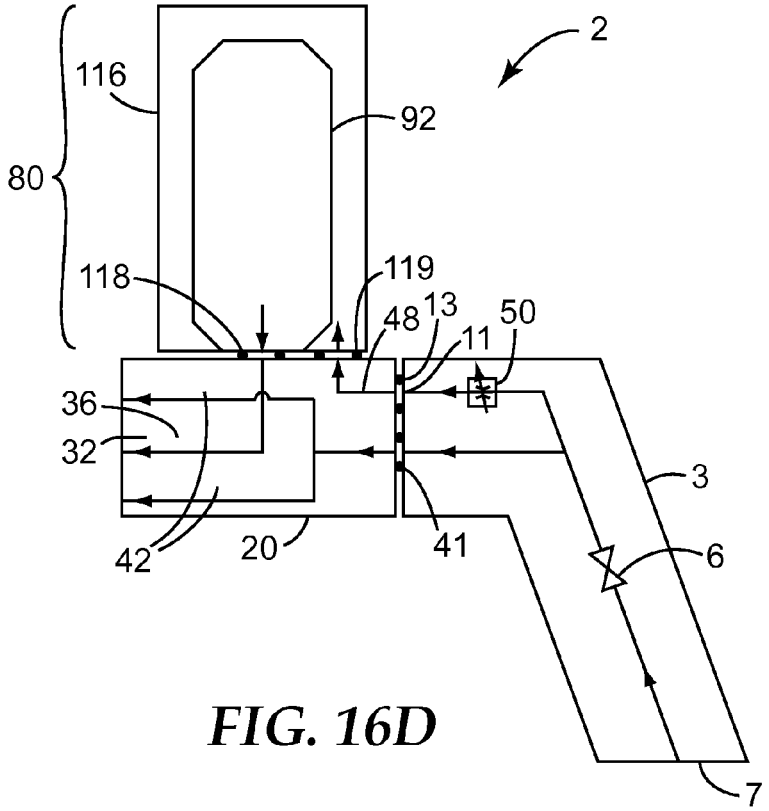
Figure 16E:
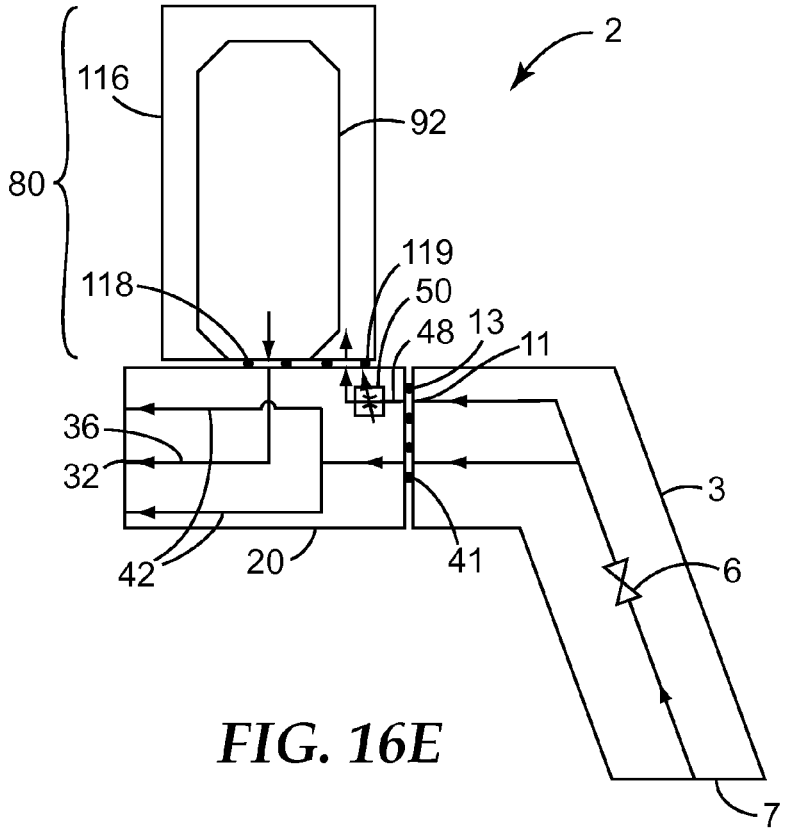

Turning now to FIGS. 13-15, a further embodiment is shown wherein the coating fluid chamber 84 comprises a separating member 92 and a cap member 94. The cap member 94 (shown separately in the exploded view of FIG. 15) is secured to the separating member 92, either directly or indirectly, by way of a suitable bonding technique such as by welding or adhesive. The cap member 94 comprises a fluid aperture 104 through which a coating fluid 60 can flow from the coating fluid chamber 84. In this example, the cap member 94 is adapted to connect to the lid member 96 via a releaseable or non-releasable mechanical connection, such as a snap fit, an interference fit, adhesive bond, sonic weld, threaded connection, twist-lock connection, or the like. Upon connection, a flow path for boost fluid 52 is preserved between the cap member 94 to the lid member 96. In this way, a boost fluid 52 can freely flow between the components while at the same time maintaining a secure mechanical connection between them.

In some embodiments, the lid member 96 is persistently connected to the cap member 94 such that the entire assembly (as shown in FIG. 14) may be installed as a unit and optionally discarded after use. In other embodiments, the cap member 94 may be readily installed into (and removed from) a discrete lid member 96 such that one or both components can be interchanged with similar components. For example, a coating fluid chamber 84 and cap member 94 may be disconnected from the lid member 96 and discarded, and a new coating fluid chamber 84 and cap member 94 connected to the same lid member 96—especially (although not necessarily) if the fluid aperture 104 is long enough to protrude through most of reservoir connector 100 of the lid member 96, such that the lid member 96 does not come into contact with coating fluid 60.

In any of the embodiments described herein, a coating fluid chamber closure 85 may be provided to close the coating fluid chamber 84 to prevent or slow deterioration of a coating fluid 60 therein. One example is depicted in dashed lines in FIG. 4. In some embodiments, the coating fluid chamber closure 85 is made accessible through the fluid aperture 104 such that it can be defeated or removed to permit a coating fluid 60 to exit the fluid aperture 104. In some cases, such a coating fluid chamber closure 85 may be provided factory-installed to seal in a particular coating fluid 60. For example, an end user may select a particular premixed coating fluid 60 for a given application. In such case, a coating fluid chamber 84 containing that fluid may be provided to the end user with a coating fluid chamber closure 85 comprising a foil seal to be pierced by the end user just prior to application. In one embodiment (see also dashed lines in FIG. 4), the barrel 20 comprises a piercing member 86 to automatically pierce the coating fluid chamber closure 85 upon installation of the coating fluid chamber 84 onto the spray gun 2. Such coating fluid chamber closures 85 and/or piercing members may be incorporated into any of the embodiments disclosed herein, and are not limited to use in the embodiments shown in FIG. 4.

In such embodiments, once pierced and prior to application of coating fluid 60, the end user may add (for example by injection) a catalyst or other additive into the coating fluid chamber 84. This step may be performed prior to or after assembly of the coating fluid reservoir 80 onto the barrel 20. It is also envisioned that the coating fluid chamber 84 may also comprise more than one section containing different coating fluids or components of coating fluids, and that such sections may both be pierced prior to application. For example, the coating fluid chamber 84 may comprise a first section comprising a coating fluid 60 and a second section comprising a catalyst for the coating fluid 60. Upon piercing, the fluids in the two sections are permitted to combine prior to application. In some embodiments, the barrel 20 or coating fluid reservoir 80 (e.g., perhaps integral to the lid member 96 or cap member 94, comprises a piercing member 86 that pierces both sections upon installation of the coating fluid reservoir 80 onto the barrel 20. Although "piercing" is explicitly discussed above as an example, other forms of defeating or opening the coating fluid chamber closure 85 are contemplated—for example, rupturing, removing an adhesive tab, melting, tearing, etc.

In embodiments without a closure member, or where a coating fluid chamber closure 85 is pierced prior to assembly of the coating fluid reservoir 80 on to the barrel, the spray gun 2 may need to be inverted prior to connection (i.e., to prevent coating fluid from leaking out of the coating fluid reservoir 80).

Turning now to FIGS. 16A-17B, multiple schematic representations of exemplary spray guns are shown. These figures are intended to show multiple (but not all) possible combinations and configurations of features in accordance with the present disclosure.

In FIGS. 16A-16E, multiple schematic representations of exemplary spray guns having separable barrels are shown. Table 1 below briefly summarizes the features depicted in these embodiments, along with embodiments not shown. The list of embodiments in Table 1 is not intended to be exhaustive, but merely represents a sampling of possible embodiments.

TABLE 1

| FIG. | Dedicated boost port 11 on spray gun platform 3 | Boost variable flow control 50 | Location of boost variable flow control 50 |
|---|---|---|---|
| 16A | No | No | N/A |
| 16B | No | Yes | Barrel 20 |
| 16C | No | Yes | Coating fluid reservoir 80 |
| 16D | Yes | Yes | Spray gun platform 3 |
| 16E | Yes | Yes | Barrel 20 |
| Not shown | Yes | Yes | Coating fluid reservoir 80 |
| Not shown | Yes | No | N/A |

Figure 17A:
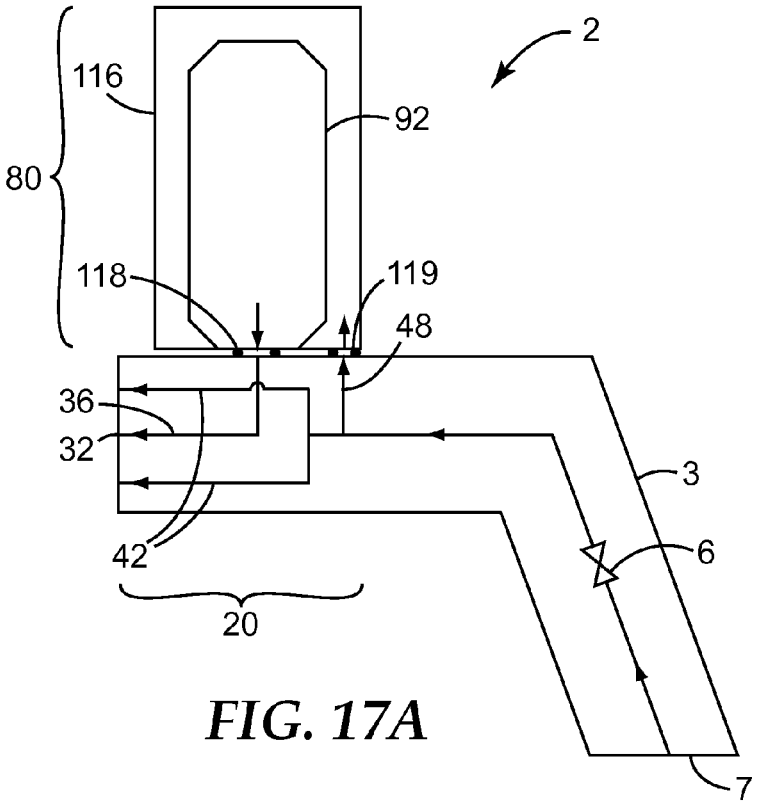
FIGS. 17A-17B depict schematic views of exemplary spray guns comprising integral barrels according to the present disclosure.
Figure 17B:
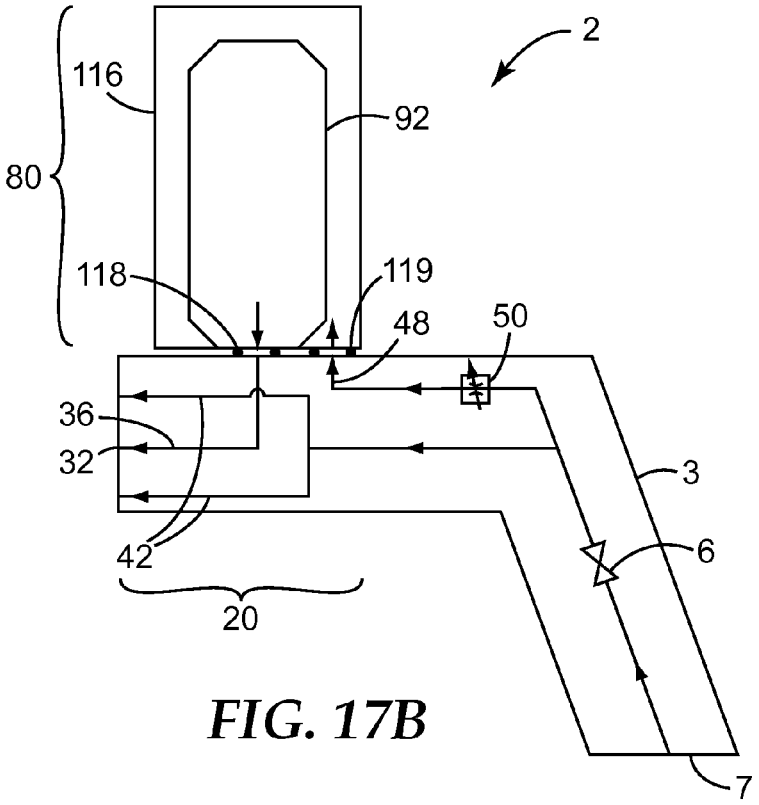

Turning now to FIGS. 17A-17B, two schematic representations of exemplary spray guns having integral barrels are shown. Table 2 below briefly summarizes the features depicted in these embodiments, along with embodiments not shown. The list of embodiments in Table 2 is not intended to be exhaustive, but merely represents a sampling of possible embodiments.

TABLE 2

| FIG. | Boost variable flow control 50 | Location of boost variable flow control 50 |
|---|---|---|
| 17A | No | N/A |
| 17B | Yes | Spray gun platform 3 |
| Not shown | Yes | Coating fluid reservoir 80 |

Figure 18:
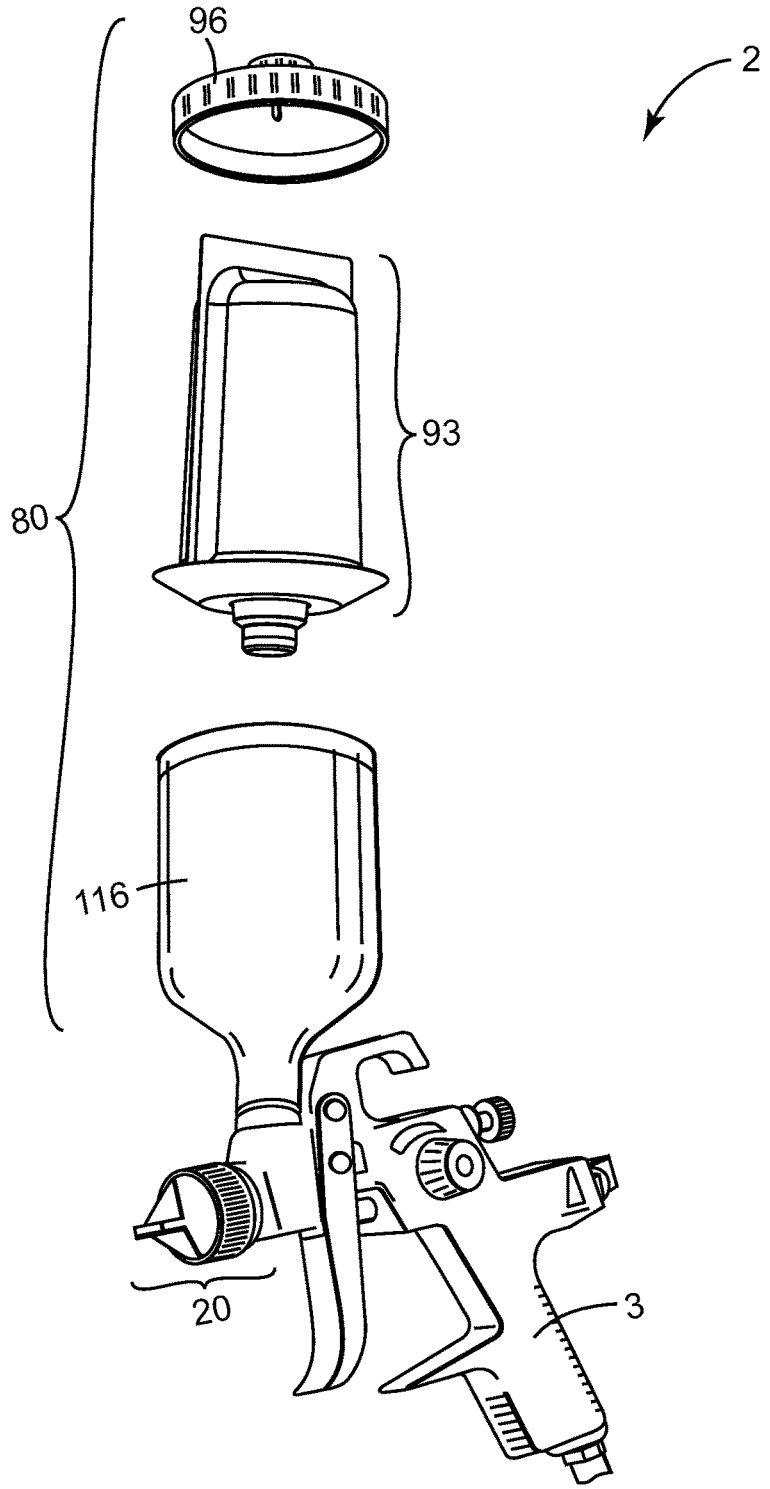
FIG. 18 depicts an exploded perspective view of an exemplary spray gun according to the present disclosure.

In some embodiments, such as the one depicted in FIG. 18, a coating fluid chamber 84 (e.g., in the form of a pouch 93) may be "top-loaded" into an open top end of an outer housing 116, with the open end of the outer housing 116 then being closed by a lid member 96. For example, the coating fluid reservoir 80 may comprise an integrally-formed fluid aperture 104 for connection to a spray gun platform 3 and an open end opposite the fluid aperture 104. For example, the outer housing 116 may be provided on one end with an integral fluid aperture 104 and/or reservoir connector 100, and on the opposite end an opening through which a coating fluid chamber 84 containing a coating fluid 60 (e.g., in the form of a pouch 93) could be inserted. In such embodiments, a lid member 96 is provided to close the open end of the outer housing 116 and seal the boost fluid chamber 88. In the example shown, the lid member comprises an optional pressure relief member 12 (reference numeral not shown in this figure), but such pressure relief member may be omitted or provided on the outer housing 116.

Various modifications and alterations of the invention will be apparent to those skilled in the art without departing from the spirit and scope of the invention. It should be understood that the invention is not limited to illustrative embodiments set forth herein.

What is claimed is:

1. A barrel adapted for use with a gravity fed spray gun, the barrel comprising:

a gun interface adapted to connect the barrel to a gravity fed spray gun platform;

a fluid interface adapted to connect the barrel to a coating fluid reservoir, the fluid interface comprising a fluid port;

a fluid nozzle opening through which a coating fluid to be sprayed can exit the barrel, the fluid nozzle opening being fluidly connected to the fluid port by a fluid passageway formed within the barrel;

wherein the fluid passageway is adapted to convey a coating fluid urged from the compatible coating fluid reservoir out of the fluid nozzle opening for spraying by the gravity fed spray gun;

a boost feed port fluidly connected to a boost passageway, the boost passageway being integral to the barrel;

wherein the boost passageway is adapted to convey a pressurized boost fluid originating in the gravity fed spray gun to a boost delivery port to assist in urging a coating fluid from the compatible coating fluid reservoir for spraying by the gravity fed spray gun.

2. The barrel of claim 1 wherein the fluid interface comprises the boost delivery port.

3. The barrel of claim 1 wherein the boost delivery port is created by connection of the fluid interface to the compatible coating fluid reservoir.

4. The barrel of claim 1 wherein at least a portion of the boost passageway is created by connection of the barrel to the compatible coating fluid reservoir.

5. The barrel of claim 1 wherein the gun interface comprises a coating fluid chamber and the boost feed port is fluidly connected to the coating fluid chamber when the barrel is assembled to the compatible spray gun platform.

6. The barrel of claim 1 wherein the boost passageway is not interrupted by a shut-off device.

7. An assembly comprising a barrel and a coating fluid reservoir adapted for use in combination with a gravity fed spray gun;

the barrel comprising a fluid interface adapted to connect the barrel to the coating fluid reservoir, the fluid interface comprising a fluid port;

a fluid nozzle opening through which a fluid to be sprayed can exit the barrel, the fluid nozzle opening being fluidly connected to the fluid port by a fluid passageway formed within the barrel;

a gun interface adapted to connect the barrel to a gravity fed spray gun platform;

a boost feed port proximate the gun interface;

the coating fluid reservoir being connected to the fluid interface and comprising a coating fluid chamber fluidly connected to the fluid port; and a boost fluid chamber fluidly connected to the boost delivery port;

a boost passageway fluidly connecting the boost feed port to a boost delivery port located proximate the fluid interface, the boost passageway being formed within the barrel;

wherein the boost passageway is adapted to convey a pressurized boost fluid originating in the gravity fed spray gun to the boost fluid chamber to assist in urging a fluid in the coating fluid chamber into the fluid passageway and out of the fluid nozzle opening.

8. The assembly of claim 7 wherein the boost passageway is at least partially created by the assembled combination of the barrel and the coating fluid reservoir.

9. The assembly of claim 7 wherein the boost delivery port is integral with the fluid interface, such that the boost passageway is integrally formed as a feature of the barrel.

10. The assembly of claim 7 wherein the coating fluid reservoir comprises a separating member to fluidly separate the coating fluid chamber from the boost fluid chamber.

11. The assembly of claim 7 wherein the boost passageway is not interrupted by a shut-off device.

12. The assembly of claim 7 wherein a fluid in the coating fluid reservoir is prevented from entering the boost passageway regardless of the orientation of the coating fluid reservoir with respect to the barrel.

13. An assembly comprising a barrel and a gravity fed spray gun, the barrel comprising a fluid interface adapted to connect the barrel to a coating fluid reservoir, the fluid interface comprising a fluid port;

a fluid nozzle opening through which a fluid to be sprayed can exit the barrel, the fluid nozzle opening being fluidly connected to the fluid port by a fluid passageway formed within the barrel;

a gun interface adapted to connect the barrel to the gravity fed spray gun;

a boost feed port proximate the gun interface and fluidly connected to a boost passageway formed within the barrel;

the gravity fed spray gun comprising a boost port housed within a barrel interface, the gravity fed spray gun being connected to the gun interface at the barrel interface;

wherein the boost passageway is adapted to convey a pressurized boost fluid originating from the boost port to a boost delivery port proximate the fluid interface to assist in urging a fluid in a compatible coating fluid reservoir into the fluid passageway and out of the fluid nozzle opening.

14. A coating fluid reservoir adapted for connection to a compatible barrel of a spray gun, the coating fluid reservoir comprising a coating fluid chamber; and a boost fluid chamber separated from the coating fluid chamber by a separating member such that the coating fluid chamber is fluidly isolated from the boost fluid chamber regardless of the orientation of the coating fluid reservoir relative to the spray gun;

a lid member comprising a reservoir connector for connection of the coating fluid reservoir to a compatible barrel;

a fluid aperture fluidly connected to the coating fluid chamber; and a boost aperture fluidly connected to the boost fluid chamber;

wherein introduction of a pressurized boost fluid to the boost fluid chamber via the boost aperture causes application of pressure to the coating fluid chamber to urge a fluid in the coating fluid chamber through the fluid aperture.

15. The coating fluid reservoir of claim 14 wherein the fluid aperture comprises a central passage surrounding an aperture axis, and the boost aperture is positioned adjacent the fluid aperture a first distance from the aperture axis.

16. The coating fluid reservoir of claim 14 wherein the boost aperture comprises a at least one aperture surrounding the fluid aperture.

17. The coating fluid reservoir of claim 14 wherein the fluid aperture is defined by an axial passage through a coupling protrusion, the coupling protrusion comprising a protrusion mating surface configured to seal against a compatible barrel of a spray gun.

18. The coating fluid reservoir of claim 17 wherein the boost aperture comprises a plurality of apertures surrounding the coupling protrusion.

19. The coating fluid reservoir of claim 14 wherein the lid member further comprises a reservoir connector comprising a retention member adapted to retain the lid member on a compatible barrel.

20. The coating fluid reservoir of claim 14 wherein the separating member comprises a compressible pouch surrounding the coating fluid chamber.

21. The coating fluid reservoir of claim 14 wherein the boost fluid chamber surrounds the coating fluid chamber.

22. The coating fluid reservoir of claim 14 wherein the boost fluid chamber is surrounded by an outer housing.

23. The coating fluid reservoir of claim 22 wherein the outer housing comprises the lid member and a separable cup member.

24. The coating fluid reservoir of claim 23 wherein the lid member is joined to the separable cup member by a collar.

25. The coating fluid reservoir of claim 22 wherein the lid member is integral with and forms one end of the outer housing.

26. The coating fluid reservoir of claim 14 comprising a fluid aperture sealing member adapted to fluidly isolate the fluid aperture from the boost aperture upon connection of the coating fluid reservoir to a compatible barrel.

27. The coating fluid reservoir of claim 14 comprising a boost aperture sealing member adapted to fluidly isolate the boost aperture from an ambient atmosphere upon connection of the coating fluid reservoir to a compatible barrel.

28. A gravity fed spray gun comprising a gravity fed spray gun platform, the gravity fed spray gun platform comprising a barrel, the barrel comprising a boost passageway, a fluid passageway, and a fluid interface, the fluid interface comprising a boost delivery port in fluid communication with the boost passageway and a fluid port in fluid communication with the fluid passageway;

wherein the barrel is separable from the gravity fed spray gun platform and wherein the barrel comprises a gun interface and the spray gun platform comprises a barrel interface, the gun interface being releasably connected to the barrel interface.

29. The gravity fed spray gun of claim 28 further comprising a fluid inlet and a trigger valve, wherein the boost delivery port is in fluid communication with the fluid inlet upon actuation of the trigger valve.

30. The gravity fed spray gun of claim 28 further comprising a coating fluid reservoir connected to the fluid interface.

31. The gravity fed spray gun of claim 30 wherein the coating fluid reservoir comprises a boost aperture in fluid communication with the boost delivery port, and a fluid aperture in fluid communication with the fluid port.

32. The gravity fed spray gun of claim 31 wherein the coating fluid reservoir comprises a boost fluid chamber in fluid communication with the boost aperture and a coating fluid chamber in fluid communication with the fluid aperture.

33. The gravity fed spray gun of claim 32 wherein the coating fluid reservoir comprises a separating member fluidly isolating the boost fluid chamber from the coating fluid chamber.

* * * * *